United States Patent [19]

Watanabe et al.

[11] Patent Number: 4,578,346

[45] Date of Patent: Mar. 25, 1986

[54] SILVER HALIDE COLOR PHOTOGRAPHIC LIGHT-SENSITIVE MATERIALS

[75] Inventors: Toshiyuki Watanabe; Morio Yagihara; Keiichi Adachi, all of Kanagawa, Japan

[73] Assignee: Fuji Photo Film Co., Ltd., Kanagawa, Japan

[21] Appl. No.: 696,545

[22] Filed: Jan. 30, 1985

Related U.S. Application Data

[63] Continuation-in-part of Ser. No. 571,762, Jan. 18, 1984, abandoned.

[30] Foreign Application Priority Data

Jan. 19, 1983 [JP] Japan ..... 58-7151

[51] Int. Cl.[4] ..... G03C 7/26

[52] U.S. Cl. ..... 430/548; 430/502; 430/505; 430/553; 430/555; 430/557; 430/558

[58] Field of Search ..... 430/226, 381, 548, 549, 430/553, 557, 555, 558, 502, 505

[56] References Cited

U.S. PATENT DOCUMENTS 4,420,556 12/1983 Booms et al. ..... 430/558
4,436,808 3/1984 Yagihara et al. ..... 430/548
4,455,363 6/1984 Naito et al. ..... 430/226
4,489,155 12/1984 Sakanoue et al. ..... 430/549

*Primary Examiner*—J. Travis Brown
*Attorney, Agent, or Firm*—Sughrue, Mion, Zinn, Macpeak, and Seas

[57] ABSTRACT

A silver halide color photographic light-sensitive material is disclosed. The material is comprised of a support having two layers thereon. One layer is comprised of a silver halide emulsion layer containing a non-diffusible coupler which couples with an oxidation product of a developing agent during development processing to form a dye of such mobility that controlled image smearing occurs. The other layer is comprised of a silver halide emulsion layer containing a polymer coupler latex which is adjacent to the emulsion layer containing the dye diffusion type coupler. By utilizing the silver halide color photographic light-sensitive material as disclosed within the application it is possible to obtain improved results with respect to the graininess and sharpness of the images produced with the material without having bad effects on other photographic properties of the material.

33 Claims, No Drawings

SILVER HALIDE COLOR PHOTOGRAPHIC LIGHT-SENSITIVE MATERIALS

CROSS REFERENCE TO RELATED APPLICATION

This is a continuation-in-part application of Ser. No. 571,762 filed Jan. 18, 1984, now abandoned.

FIELD OF THE INVENTION

The present invention relates to silver halide color photographic light-sensitive materials having improved graininess and improved sharpness, wherein a non-diffusible, non-polymeric coupler which couples with an oxidation product of a developing agent during development processing to form a dye of such mobility that controlled image smearing occurs (hereafter often referred to as dye diffusion type coupler) and a polymer coupler are used together.

BACKGROUND OF THE INVENTION

Basic techniques for improving graininess of images in silver halide color photographic light-sensitive materials involve improving the emulsion so as to have fine grains (namely, improvement of the ratio of granularity/sensitivity) and to highly activate the coupler so as to give a granulation disappearance effect. However, in order to respond to needs for making highly sensitized photographic light-sensitive materials in recent years, it is necessary to increase the particle size of the emulsion to a certain degree. This inevitably causes deterioration of graininess. Further, high activation of the coupler induces deterioration of granularity in an exposure range having low color density. Accordingly, it is desired to provide a technique by which graininess does not deteriorate even though the color photographic light-sensitive material is highly sensitized. As one means for overcoming the above described problem, it has been described in U.S. Pat. No. 4,420,556 to use a method of diffusing a dye formed by coupling with an oxidation product of a developing agent during development processing. According to this method, though the effect of improving graininess is observed, sharpness unexpectedly deteriorates. In U.S. Pat. No. 4,436,808, specific polymer coupler latexes are used to provide magenta images having improved graininess and sharpness. The polymer coupler latexes are connected to the polymer chain through the portion of coupling releasable group so that it is possible to diffuse the dyes formed by controlling the diffusibility of the portion which forms the dye upon color development. However, this patent is silent on the use of non-polymeric, dye diffusion type couplers in combination with the polymer coupler latexes, let alone specific location of these compounds in color photographic light-sensitive materials resulting in much improved graininess and sharpness.

SUMMARY OF THE INVENTION

Accordingly, an object of the present invention is to provide silver halide color photographic light-sensitive materials wherein graininess is improved without damaging image sharpness when using the above described diffusion dye-forming, non-diffusion type non-polymeric coupler.

Another object of the present invention is to improve graininess without producing side effects when using the dye diffusion type coupler.

These objects of the present invention are attained by providing silver halide color photographic light-sensitive materials which comprise a support and at least two layers consisting of a non-polymeric, dye diffusion type coupler which couplers with an oxidation product of a developing agent during development processing to form a dye of such mobility that controlled image smearing occurs and a silver halide emulsion layer containing a polymer coupler latex adjacent to said layer.

DETAILED DESCRIPTION OF THE INVENTION

The term "mobility that controlled image smearing occurs" as used herein is established in the art (cf. U.S. Pat. No. 4,420,556) and means allowing the image dye produced to diffuse to a limited extent, neighboring clouds of image dye are smeared into each other.

In the present invention the silver halide emulsion layers each may be any of blue-sensitive layer, green-sensitive layer and red-sensitive layer; or, a group composed of at least two emulsion layers may have the same color sensitivity or different color sensitivity from each other. Further, two or more groups composed of the two emulsion layers having the relation of the present invention may be placed on a support. When a layer having a certain color sensitivity consists of three or more emulsion layers, it is sufficient if at least two adjacent layers comply with the relation of the present invention. In any case, at least two emulsion layers satisfying the relation of the present invention, make a unit combination or group and these emulsion layers in one unit combination or group should have the same color sensitivity.

The dye diffusion type couplers are applid as an emulsified dispersion after being dissolved in a high boiling point organic solvent (hereinafter referred to as oil) conventionally used in the photographic field. The coupler forms a diffusion dye in the development processing, and the degree of diffusion of the dye depends upon distribution between an oil phase and a developing solution permeating into the emulsion layer (aqueous phase). Namely, diffusion of the dye increases as the distribution into the developing solution increases, and consequently controlled image smearing occurs. This causes improvement of both graininess and sharpness that are normally contradictory effects.

A part of dye diffusing into the aqueous phase in the emulsion layer diffuses into oil droplets in said layer and an emulsion layer adjacent to said layer, and it is again caught in oil droplets in the layer. When the amount of oil in the adjacent layer is large, namely, the ratio of oil to binder is high, diffusion into the adjacent layer is accelerated. As a result, sharpness remarkably deteriorates. Such a phenomenon has not been known at all hitherto.

It has been found that the above described phenomenon can be improved by reducing the amount of oil added to the adjacent layer. However, it is not easy to carry out reduction of the amount of oil added with couplers conventionally used due to problems with the preservation property or coloring property. However, by using a polymer coupler latex, this fault is overcome and it becomes possible to remarkably reduce the amount of oil added. Consequently, it becomes possible to greatly improve deterioration of sharpness due to the dye diffusion type coupler. Discovering that the amount of oil necessary to disperse the coupler can be remarkably reduced when using the polymer coupler latex is the basis of the present invention.

In the present invention, the above described objects have been attained by using a polymer coupler which does not require oil or which can be stably dispersed with a small amount of oil in the adjacent layer, in order to sufficiently diffuse the dye in the emulsion layer containing the dye diffusion type coupler as well as minimize diffusion of the dye into the adjacent layer. Further, by using the polymer coupler in the adjacent layer, it has been possible to thin the layer, by which an effect of improving sharpness is obtained.

According to the present invention, it is possible to attain improvement of graininess and improvement of sharpness together.

In the present invention, a silver halide color photographic light-sensitive material comprising a support having thereon (1) an emulsion layer containing an dye diffusion type coupler and (2) an emulsion layer containing a polymer coupler latex in that order, the emulsion layer (2) being positioned adjacent to the emulsion layer and having a higher sensitivity than the emulsion layer (1), is particularly effective.

In embodiments of the present invention, a color sensitive emulsion layer may be composed of two layers or it may have a three-layer construction composed of three emulsion layers each having a different sensitivity.

In the emulsion layer containing dye diffusion type couplers, other couplers used hitherto may be present together. Further, the polymer coupler may be used together with other couplers used hitherto.

Two or more dye diffusion type couplers may be used together, and two or more polymer couplers may be used together. Silver halide in the emulsion layer containing a dye diffusion type coupler is not restricted, and it is possible to use tabular particles having a diameter of 5 or more times of thickness.

The dye diffusion type couplers used in the present invention are non-polymeric as defined above and include those represented by the following general formula (B):

$$(Cp\rightarrow)_a X— \quad (B)$$

wherein Cp represents a coupler group capable of diffused which forms a dye of such mobility that controlled color image smearing occurs to improve graininess, X represents a group which bonds to a coupling position of the coupler group and is released by a reaction with an oxidation product of a color developing agent, which is a group containing a ballast group having 8 to 32 carbon atoms, and a represents 1 or 2.

Among couplers represented by the general formula (B), couplers represented by the following formulae are preferred.

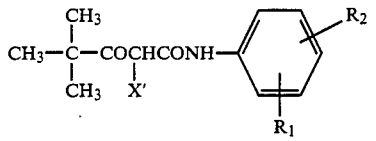

(I)

-continued

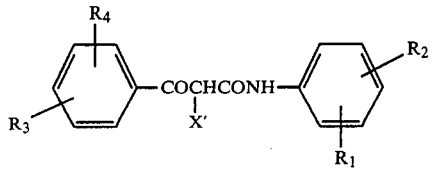

(II)

wherein $R_1$, $R_2$, $R_3$ and $R_4$ which may be identical or different represent each a hydrogen atom, a halogen atom (for example, fluorine, chlorine, bromine and iodine), an alkyl group (for example, a methyl group, an ethyl group, an isopropyl group or a hydroxyethyl group, etc.), an alkoxy group (for example, a methoxy group, an ethoxy group or a methoxyethoxy group, etc.), an aryloxy group (for example, a phenoxy group, etc.), an acylamino group (for example, an acetylamino group or a trifluoroacetylamino group, etc.), a sulfonamido group (for example, a methanesulfonamido group or a benzenesulfonamido group, etc.), a carbamoyl group, a sulfamoyl group, an alkylthio group, an alkylsulfonyl group, an alkoxycarbonyl group, a ureido group, a cyano group, a carboxyl group, a hydroxy group or a sulfo group, but the total of carbon atoms in $R_1$, $R_2$, $R_3$ and $R_4$ is not beyond 10. X' represents a group having the so-called ballast group having 8 to 32 carbon atoms which give a non-diffusion property to the coupler, which can be released by coupling with an oxidation product of an aromatic primary amine developing agent. In detail, X' can be represented by the following general formula (III) or (IV).

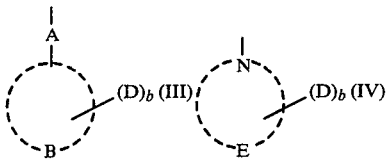

wherein A represents an oxygen atom or a sulfur atom, B represents a group of non-metal atoms necessary to form an aryl ring or a hetero ring, and E represents a group of non-metal atoms necessary to form a 5-membered or 6-membered heterocyclic ring together with the nitrogen atom. These rings may be fused with another aryl ring or heterocyclic ring. D represents a ballast group. b represents a positive integer. When b is a plural number, D may be identical or different, and $(D)_b$ can have the total carbon atom of 8 to 32. D may contain linking groups such as —O—, —S—, —COO—, —CONH—, —$SO_2$NH—, —NHCONH—, —$SO_2$—, —CO— or —NH—, etc.

In the general formula (B), other preferred couplers are represented by the following general formulae (V), (VI) and (VII).

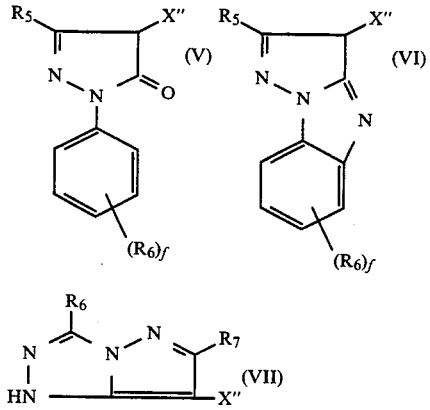

wherein $R_5$ represents an amido group (for example, a propanamido group or a benzamido group), an anilino group (for example, a 2-chloroanilino group or a 5-acetamidoanilino group) or a ureido group (for example, a phenyl ureido group or a butaneureido group), $R_6$ and $R_7$ represent each a halogen atom, an alkyl group (for example, a methyl group or an ethyl group), an alkoxy group (for example, a methoxy group or an ethoxy group), an acylamido group (for example, an acetamido group or a benzamido group), an alkoxycarbonyl group (for example, a methoxycarbonyl group), a N-alkylcarbamoyl group (for example, a N-methylcarbamoyl group), a ureido group (for example, a N-methylureido group), a cyano group, an aryl group (for example, a phenyl group or a naphthyl group), a N,N-dialkylsulfamoyl group, a nitro group, a hydroxy group, a carboxyl group or an aryloxy group, and f represents 0 or an integer of 1 to 4. When f is 2 or more, each $R_6$ may be identical or different. However, the total of carbon atoms in $R_5$ and $(R_6)_f$ in general formulae (V) and (VI) and that in $R_6$ and $R_7$ in General formula (VII) are not beyond 10. X'' represents the following general formula (VIII), (IX) or (X).

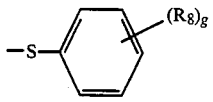

(VIII)

$-S-R_8$ (IX)

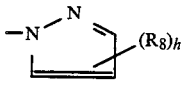

(X)

$R_8$ represents a ballast group comprising a substituted or unsubstituted alkyl group (for example, a butyl group or a dodecyl group, etc.), an aralkyl group (for example, a benzyl group, etc.), an alkenyl group (for example, an allyl group, etc.), an unsubstituted or substituted aryl group (for example, a phenyl group) or a cycloalkyl group (for example, a cyclopentyl group, etc.). The substituents of them are selected from halogen atoms, alkoxy groups (for example, butoxy group and dodecyloxy group, etc.), acylamido groups (for example, acetamido group and tetradecanamido group, etc.), alkoxycarbonyl groups (for example, tetradecyloxycarbonyl group, etc.), N-alkylcarbamoyl groups (for example, N-dodecylcarbamoyl group, etc.), ureido groups (for example, tetradecylureido group, etc.), cyano group, aryl groups (for example, phenyl group, etc.), nitro group, alkylthio group (for example, dodecylthio group, etc.), alkylsulfinyl groups (for example, tetradecylsulfonyl group, etc.), alkylsulfon groups, anilino groups, sulfonamido groups (for example, hexadecanesulfonamido group, etc.), N-alkylsulfamoyl groups, aryloxy groups and acyl groups (tetradecanoyl group, etc.). The total of carbon atom numbers contained in $R_8$ is 8 to 32. The symbol g represents an integer of 1 to 5 and h represents 0 or an integer of 1 to 3.

Among couplers represented by the general formula (B), other preferred couplers are represented by the following general formulae (XI) and (XII).

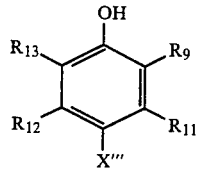

(XI)

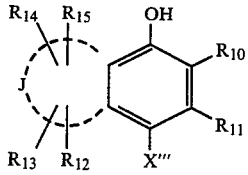

(XII)

wherein $R_9$ represents a hydrogen atom, an aliphatic group having 10 or less carbon atoms (for example, an alkyl group such as a methyl, isopropyl, amyl, cyclohexyl or octyl group), an alkoxy group having 10 or less carbon atoms (for example, a methoxy group, an isopropoxy group or a pentadecyloxy group), an aryloxy group (for example, a phenoxy group or a p-tert-butylphenoxy group), or an acylamido group, sulfonamido group or ureido group represented by the following formulae (XIII) to (XV) respectively or a carbamoyl group represented by the following formula (XVI).

$-NH-CO-G$ (XIII)

$-NH-SO_2-G$ (XIV)

$-NHCONH-G$ (XV)

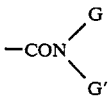

(XVI)

In the formulae, G and G' which may be identical or different each represents a hydrogen atom (but G and G' do not represent hydrogen atoms at the same time, and the total of carbon atom numbers in G and G' is 1 to 12), an aliphatic group having 1 to 12 carbon atoms, preferably a straight or branched alkyl group having 4 to 10 carbon atoms or a cycloalkyl group (for example, a cyclopropyl group, a cyclohexyl group or a norbornyl group, etc.) or an aryl group (for example, a phenyl group or a naphthyl group, etc.). The above described alkyl groups and aryl groups may be substituted by halogen atoms (for example, fluorine and chlorine, etc.), nitro group, cyano group, hydroxyl group, carboxy group, amino groups (for example, amino, alkylamino, dialkylamino, anilino, and N-alkylanilino, etc.), aryl groups (for example, phenyl, acetylaminophenyl, etc.), alkoxycarbonyl groups (for example, butyloxycarbonyl, etc.), acyloxycarbonyl groups, amido groups (for example, acetamido and methanesulfonamido, etc.), imido groups (for example, succinimido, etc.), carbamoyl groups (for example, N,N-diethylcarbamoyl, etc.), sulfamoyl groups (for example, N,N-diethylsulfamoyl, etc.), alkoxy groups (for example, ethoxy, butoxy and octyloxy, etc.) and aryloxy groups (for example, phenyloxy and methylphenoxy, etc.), etc. $R_9$ may have substituents conventionally used other than the above described substituents. $R_{10}$ represents a hydrogen atom, an aliphatic group having 12 or less carbon atoms and, preferably, an alkyl group having 1 to 10 carbon atoms, or a carbamoyl group represented by the general formula (XVI). $R_{11}$, $R_{12}$, $R_{13}$, $R_{14}$ and $R_{15}$ represent each a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group. In detail, $R_{11}$, $R_{12}$, $R_{13}$, $R_{14}$ and $R_{15}$ each represents any of the following groups: hydrogen atom, halogen atoms (for example, chlorine and bromine, etc.), primary, secondary and tertiary alkyl groups having 1 to 12 carbon atoms (for example, methyl, propyl, isopropyl, n-butyl, sec-butyl, tert-butyl, hexyl, dodecyl, 2-chlorobutyl, 2-hydroxyethyl, 2-phenylethyl, 2-(2,4,6-trichlorophenyl)ethyl and 2-aminoethyl, etc.), alkoxy groups (for example, ethoxy, butoxy and octyloxy, etc.), alkylthio groups (for example, octylthio, etc.), aryl groups (for example, phenyl, 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl and 3-ethylnaphtyl, etc.), heterocyclic groups (for example, benzofuranyl, furanyl, thiazolyl, benzothiazolyl, naphthothiazolyl, oxazolyl, benzoxazolyl, naphthoxazolyl, pyridyl and quinolynyl, etc.), amino groups (for example, amino, methylamino, diethylamino, dodecylamino, phenylamino, tolylamino, 4-cyanophenylamino, 2-trifluoromethylphenylamino or benzothiazolamino, etc.), carbonamido groups (for example, alkylcarbonamido groups such as ethylcarbonamido or decylcarbonamido, etc.), arylcarbonamido groups such as phenylcarbonamido, 2,4,6-trichlorophenylcarbonamido, 4-methylphenylcarbonamido, 2-ethoxyphenylcarbonamido and naphthylcarbonamido, etc., and heterocyclic carbonamido groups such as thiazolylcarbonamido, benzothiazolylcarbonamido, naphthothiazolylcarbonamido, oxazolylcarbonamido, benzoxazolylcarbonamido, imidazolylcarbonamido or benzimidazolylcarbonamido, etc.), sulfonamido groups (for example, alkylsulfonamido groups such as butylsulfonamido, dodecylsulfonamido or phenylethylsulfonamido, etc.), arylsulfonamido groups such as phenylsulfonamido, 2,4,6-trichlorophenylsulfonamido, 2-methoxyphenylsulfonamido, 3-carboxyphenylsulfonamido or naphthylsulfonamido, etc., and heterocyclic sullfonamido groups such as thiazolylsulfonamido, benzothiazolylsulfonamido, imidazolylsulfonamido, benzoimidazolylsulfonamido or pyridylsulfonamido, etc.), sulfamoyl groups (for example, alkylsulfamoyl groups such as propylsulfamoyl or octylsulfamoyl, etc., arylsulfamoyl groups such as phenylsulfamoyl, 2,4,6-trichlorophenylsulfamoyl, 2-methoxyphenylsulfamoyl or naphthylsulfamoyl, etc., and heterocyclic sulfamoyl groups such as thiazolylsulfamoyl, benzothiazolylsulfamoyl, oxazolylsulfamoyl, benzimidazolylsulfamoyl or pyridylsulfamoyl, etc.) and carbamoyl groups (for example, alkylcarbamoyl groups such as ethylcarbamoyl or octylcarbamoyl, etc., arylcarbamoyl groups such as phenylcarbamoyl or 2,4,6-trichlorophenylcarbamoyl, etc., and heterocyclic carbamoyl groups such as thiazolylcarbamoyl, benzothiazolylcarbamoyl, oxazolylcarbamoyl, imidazolylcarbamoyl or benzimidazolylcarbamoyl, etc.). J represents non-metal atoms necessary to form a 5- and/or 6-membered ring as described in the following. Namely, a benzene ring, a cyclohexane ring, a cyclopentene ring, a thiazole ring, an oxazole ring, an imidazole ring, a pyridine ring and a pyrrole ring, etc. Among them the benzene ring is preferred.

X''' represents a group which has a ballast group having 8 to 32 carbon atoms and bonds to a coupling position through —O—, —S— or —N=N— thereof, which releases by coupling with an oxidation product of an aromatic primary amine developing agent. Preferably, it represents an alkoxy, aryloxy, alkylthio or arylthio group having 8 to 32 carbon atoms. These groups may contain divalent groups such as

—O—, —S—, —NH—, —CONH—, —COO—, —$SO_2$NH—,

—SO—, —$SO_2$—, —CO—, —NH$\overset{O}{\overset{\|}{C}}$NH— or 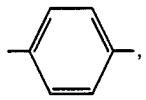 , etc. It is particularly preferred that these groups further contain groups dissociating with alkali, such as —COOH, —$SO_3$H, —OH or —$SO_2NH_2$. Further, it is possible to make a substantially non-diffusible coupler by combining $R_9$, $R_{10}$, $R_{11}$, $R_{12}$, $R_{13}$, $R_{14}$, $R_{15}$ and X'''.

In the following, preferred examples of dye diffusion type couplers according to the present invention are described, but the present invention is not construed as being limited thereto.

BY-1

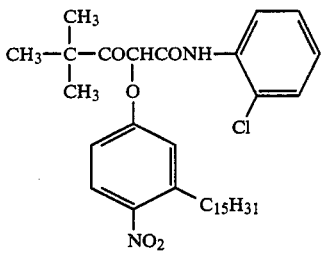

BY-2

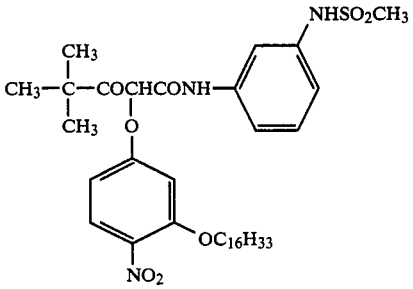

-continued
BY-3
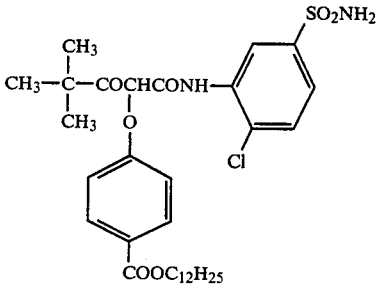
BY-4
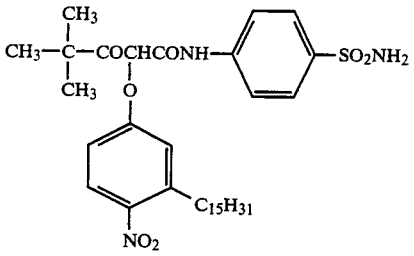
BY-5
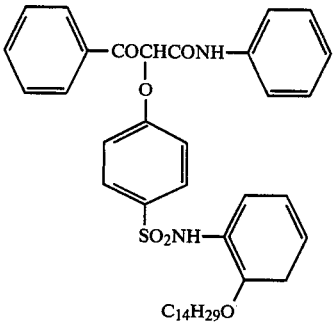
BY-6
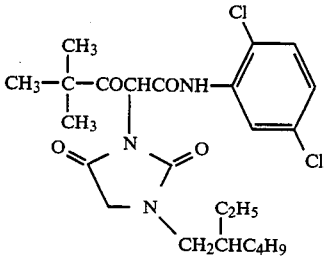
BY-7
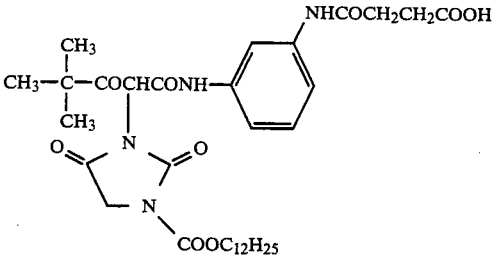
BY-8
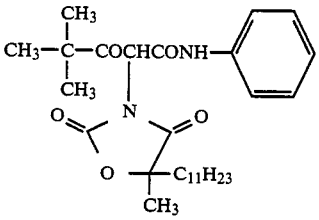
-continued
BY-9
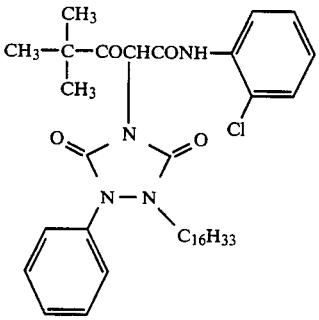
BY-10
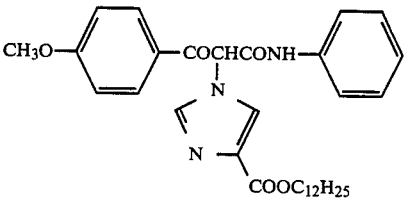
BY-11
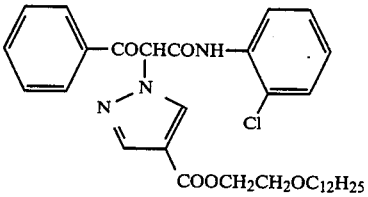
BY-12
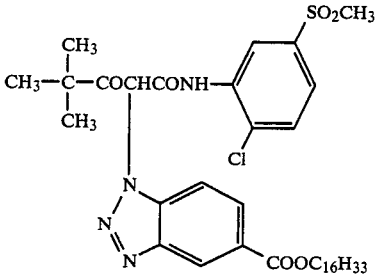
BY-13
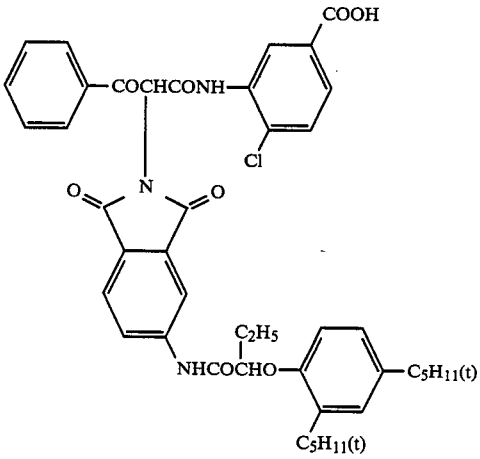

-continued
BY-14
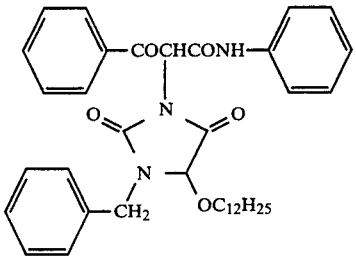
BY-15
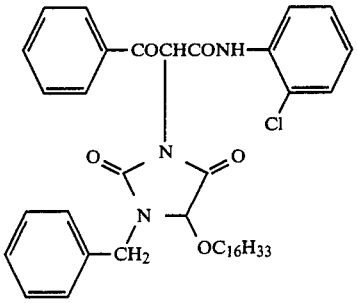
BM-1
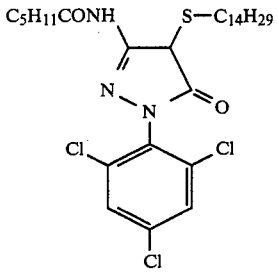
BM-2
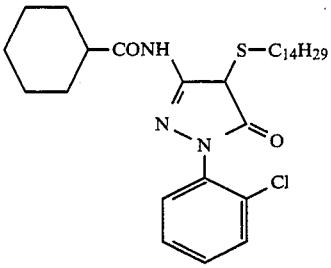
BM-3
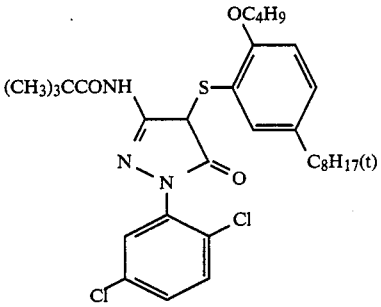
-continued
BM-4
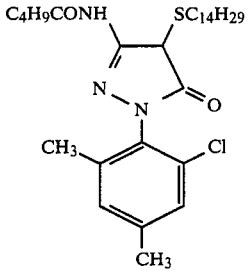
BM-5
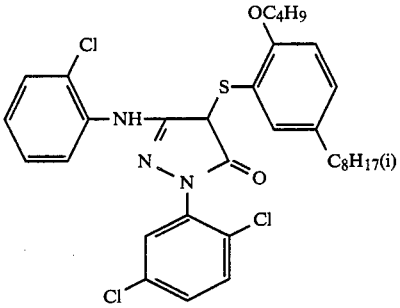
BM-6
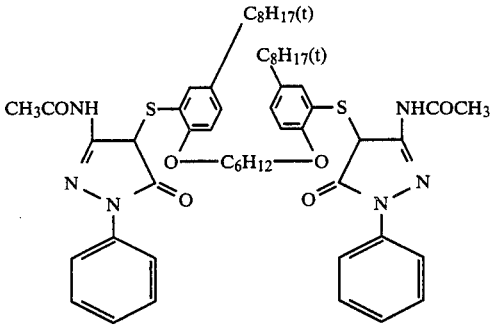
BM-7
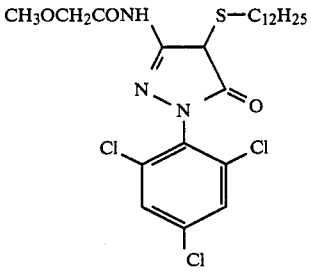
BM-8
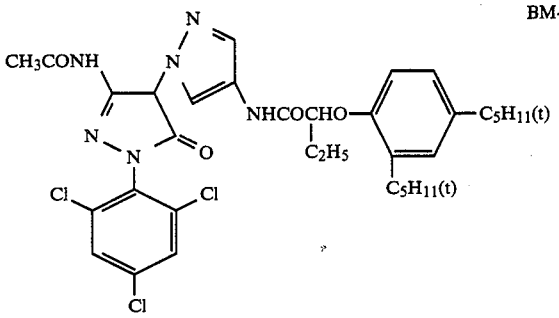

-continued
BM-9
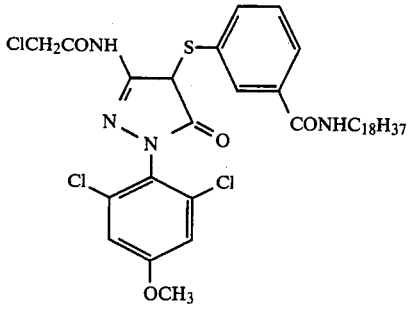
BM-10
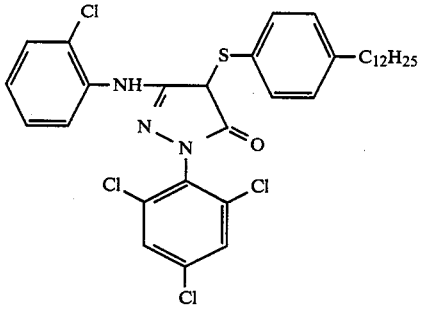
BM-11
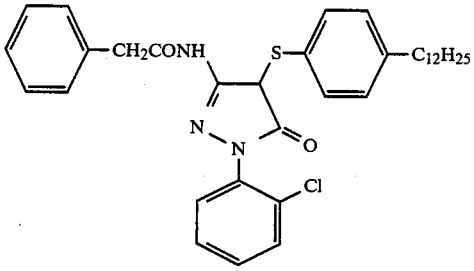
BM-12
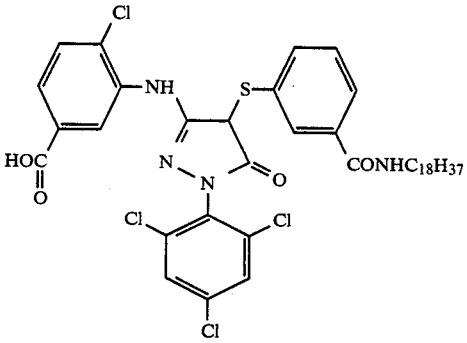
BM-13
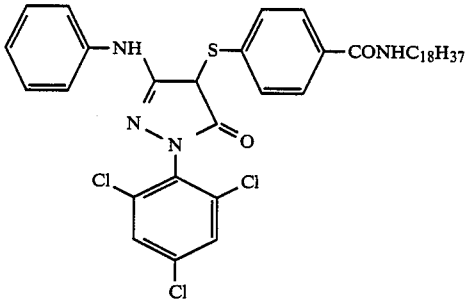
-continued
BM-14
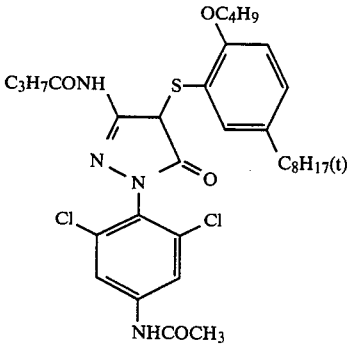
BM-15
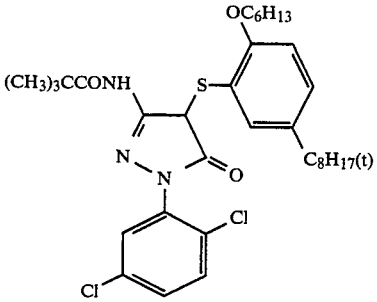
These compounds according to the present invention can be synthesized by processes described in U.S. Pat. Nos. 4,264,723, 3,227,554, 4,310,619, 4,301,235 and 4,407,936 (incorporated herein by reference to disclose such processes) and Japanese Patent Applications (OPI) 4044/82 and 12935/75, etc.
BC-1
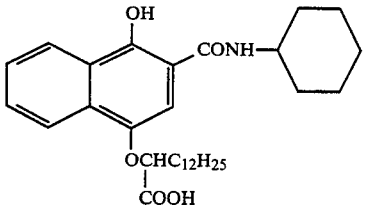
BC-2
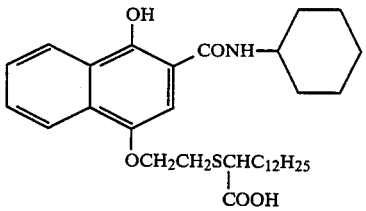
BC-3
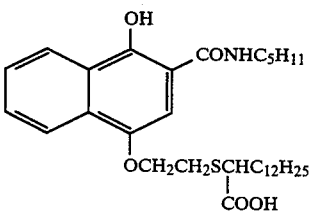

-continued
BC-4
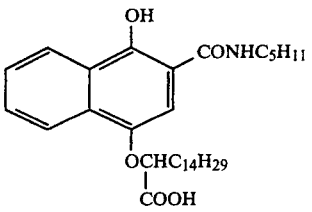
BC-5
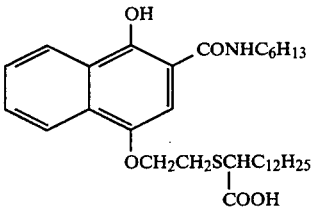
BC-6
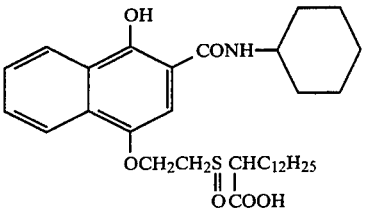
BC-7
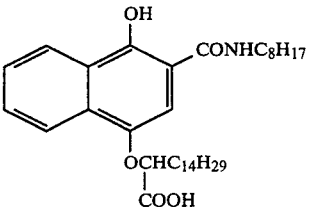
BC-8
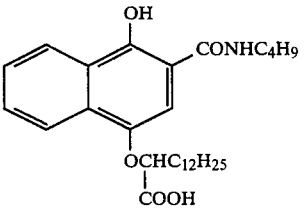
BC-9
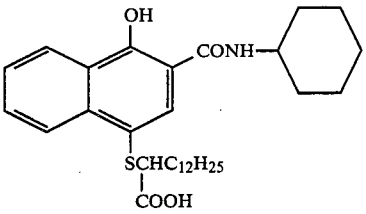
BC-10
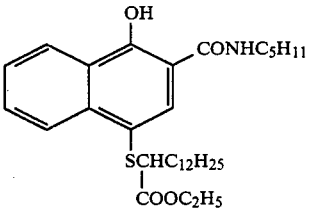
-continued
BC-11
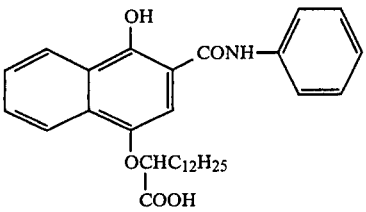
BC-12
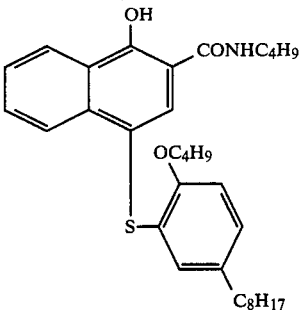
BC-13
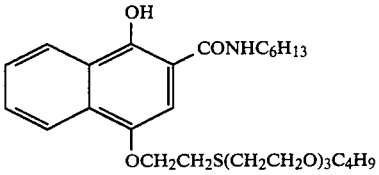
BC-14
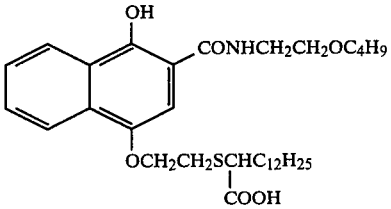
BC-15
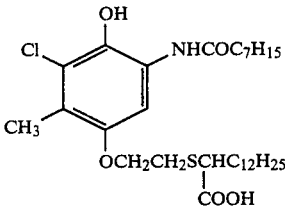
BC-16
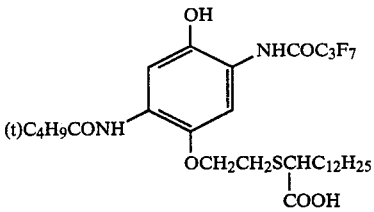
BC-17
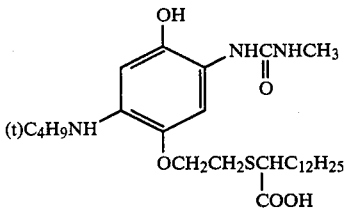

-continued

BC-18

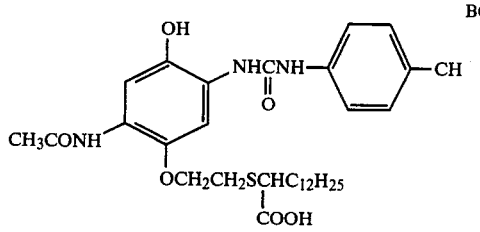

BC-19

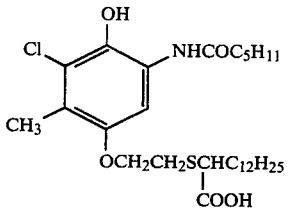

These compounds according to the present invention can be easily synthesized by processes described in U.S. Pat. No. 4,296,199 and Japanese Patent Application (OPI) Nos. 3934/82 and 105226/78, etc.

It is preferred that the polymer coupler latex used in the present invention contains a polymer having a recurring unit represented by the general formula (CII) derived from a monomer coupler represented by the following general formula (CI) or a copolymer of the above described monomer coupler and one or more non-coloring monomers containing at least one ethylene group which do not have an ability of coupling by oxidation with an aromatic primary amine developing agent. In the present invention, two or more monomer couplers may be polymerized simultaneously.

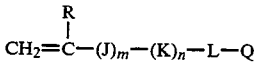

(CI)

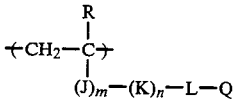

(CII)

wherein R represents a hydrogen atom, a lower alkyl group having 1 to 4 carbon atoms or a chlorine atom, L represents —CONH—, —NHCONH—, —NHCOO—, —COO—, —$SO_2$—, —CO— or —O—, J represents —CONH— or —COO—, and K represents an unsubstituted or substituted alkylene group having 1 to 10 carbon atoms, an unsubstituted or substituted aralkylene group having 7 to 12 carbon atoms or an unsubstituted or substituted arylene group having up to 10 carbon atoms, wherein the alkylene group may be straight or branched. (As the alkylene group, there are, for example, methylene, methylmethylene, dimethylmethylene, dimethylene, trimethylene, tetramethylene, pentamethylene, hexamethylene and decylmethylene. As the aralkylene group, there is, for example, benzylidene. As the arylene group, there are, for example, phenylene and naphthylene, etc.).

Q represents a cyan forming coupler group, a magenta forming coupler group or a yellow forming coupler group capable of forming a dye by coupling with an oxidation product of an aromatic primary amine developing agent.

m and n each represents 0 or 1.

As substituents of the alkylene group or arylene group represented by K, there are aryl groups (for example, phenyl group), nitro group, hydroxyl group, cyano group, sulfo group, alkoxy groups (for example, methoxy group), aryloxy groups (for example, phenoxy group), acyloxy groups (for example, acetoxy group), acylamino groups (for example, acetylamino group), sulfonamido groups (for example, methanesulfonamido group), sulfamoyl groups (for example, methylsulfamoyl group), halogen atoms (for example, fluorine, chlorine and bromine, etc.), carboxyl group, carbamoyl groups (for example, methylcarbamoyl group), alkoxycarbonyl groups (for example, methoxycarbonyl group) and sulfonyl groups (for example, methylsulfonyl group). When having two or more substituents, they may be identical or different.

As the cyan forming coupler group in the color coupler groups represented by Q, phenol type groups (CIII) and naphthol type groups (CIV) are preferred.

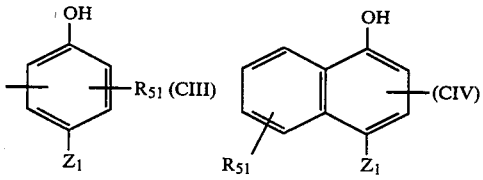

In the formulae, $R_{51}$ represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group or an arylureido group. When having two or more substituents, they may be identical or different.

$Z_1$ represents a hydrogen atom, a halogen atom, a sulfo group, an acyloxy group, an alkoxy group, an aryloxy group, a heterocyclic oxy group, an alkylthio group, an arylthio group or a heterocyclic thio group, which may be further substituted with substituents such as aryl groups (for example, phenyl group), nitro group, hydroxyl group, cyano group, sulfo group, alkoxy groups (for example, methoxy group), aryloxy groups (for example, phenoxy group), acyloxy groups (for example, acetoxy group), acylamino groups (for example, acetylamino group), sulfaonamido groups (for example, methansulfonamido group), sulfamoyl groups (for example, methylsulfamoyl group), halogen atoms (for example, fluorine, chlorine and bromine, etc.), carboxyl group, carbamoyl groups (for example, methylcarbamoyl group), alkoxycarbonyl groups (for example, methoxycarbonyl groups, etc.) and sulfonyl groups (for example, methylsulfonyl group), etc.

As the magenta forming coupler group, pyrazolone and indazolone type group are preferred. For example, there are those which are represented by the following formula:

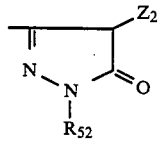

(CV)

In the formula, $R_{52}$ represents a well known substituent on 1-position of 2-pyrazolin-5-one couplers, for example, an alkyl group, a substituted alkyl group (for example, haloalkyl such as fluoroalkyl, cyanoalkyl or benzylalkyl, etc.), an aryl group or a substituted aryl group [examples of substituents include alkyl groups (for example, methyl group and ethyl group, etc.), alkoxy groups (for example, methoxy group and ethoxy group, etc.), aryloxy groups (for example, phenyloxy group, etc.), alkoxycarbonyl groups (for example, methoxycarbonyl group, etc.), acylamino groups (for example, acetylamino group), carbamoyl group, alkylcarbamoyl groups (for example, methylcarbamoyl group and ethylcarbamoyl group, etc.), dialkylcarbamoyl groups (for example, dimethylcarbamoyl group), arylcarbamoyl groups (for example, phenylcarbamoyl group), alkylsulfonyl groups (for example, methylsulfonyl group), arylsulfonyl groups (for example, phenylsulfonyl group), alkylsulfonamido groups (for example, methanesulfonamido group), arylsulfonamido group (for example, phenylsulfonamido group), sulfamoyl group, alkylsulfamoyl groups (for example, ethylsulfamoyl group), dialkylsulfamoyl groups (for example, dimethylsulfamoyl group), alkylthio groups (for example, methylthio group), arylthio groups (for example, phenylthio group), cyano group, nitro group and halogen atoms (for example, fluorine, chlorine and bromine, etc.). When having two or more substituents, they may be identical or different. Examples of particularly preferred substituents include halogen atoms, alkyl groups, alkoxy groups, alkoxycarbonyl groups and cyano group.].

$Z_2$ represents a hydrogen atom or a releasing group bonding to the coupling position through an oxygen atom, a nitrogen atom or a sulfur atom. When $Z_2$ is bonded to the coupling position through an oxygen atom, a nitrogen atom or a sulfur atom, the oxygen, nitrogen or sulfur atom is bonded to an alkyl group, an aryl group, an alkylsulfonyl group, an arylsulfonyl group, an alkylcarbonyl group, an arylcarbonyl group or a heterocyclic group (wherein the alkyl group, aryl group and heterocyclic group may have substituents described as the above described substituent of aryl groups in $R_{52}$). Further, in case of the nitrogen atom, $Z_2$ may represent a group capable of becoming a releasing group by forming a 5-membered or 6-membered ring containing the nitrogen atom (for example, an imidazolyl group, a pyrazolyl group, a triazolyl group or a tetrazolyl group, etc.).

As the yellow forming coupler group, acylacetanilide type groups, particularly, pivaloylacetanilide type groups (CVI) and benzoylacetanilide type groups (CVII) and (CVIII) are preferred.

(CVI)

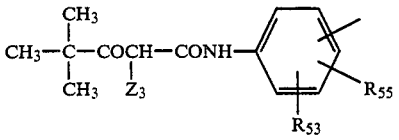

(CVII)

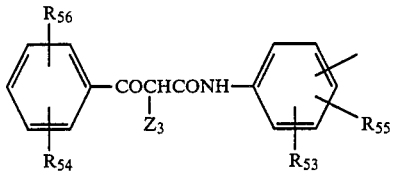

-continued (CVIII)

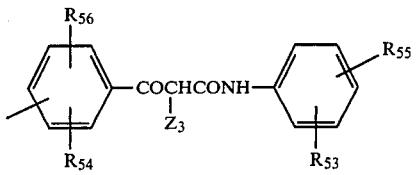

In the formulae, $R_{53}$, $R_{54}$, $R_{55}$ and $R_{56}$ each represents a hydrogen atom or a well known substituent in yellow forming coupler groups, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl substituted succinimido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group or a thiocyano group, etc., which may be identical or different.

$Z_3$ represents hydrogen atom or a group represented by the following general formula (CIX), (CXA), (CXI) or (CXII).

(CIX)

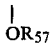

wherein $R_{57}$ represents an aryl group or a heterocyclic group, which may be substituted.

(CX) (CXI)

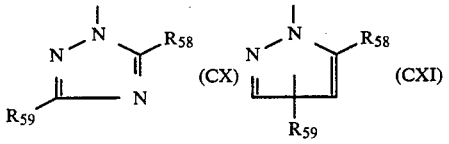

wherein $R_{58}$ and $R_{59}$ each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, a unsubstituted or substituted phenyl group or a heterocyclic group, which may be identical or different.

(CXII)

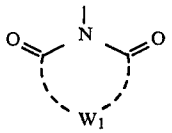

wherein $W_1$ represents non-metal atoms necessary to form a 4-membered ring, a 5-membered ring or a 6-membered ring together with

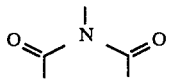

in the formula.

In the general formula (CXII), preferred groups are those represented by the formulae (CXIII) to (CXV).

(CXIII)

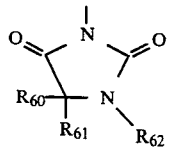

(CXIV)

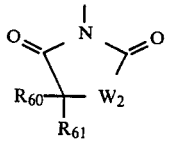

(CXV)

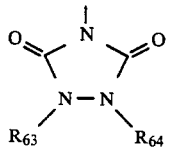

In the formulae, $R_{60}$ and $R_{61}$ represent each a hydrogen atom, an alkyl group, an aryl group, an alkoxy group, an aryloxy group or a hydroxyl group, $R_{62}$, $R_{63}$ and $R_{64}$ represent each a hydrogen atom, an alkyl group, an aryl group, an aralkyl group or an acyl group, and $W_2$ represents an oxygen atom or a sulfur atom. (m and n represent each 0 or 1.)

Examples of the noncoloring ethylenic monomers which do not couple with an oxidation product of the aromatic primary amine developing agent include acrylic acid, α-chloroacrylic acid, α-alacrylic acid (for example, methacrylic acid, etc.) and esters and amides derived from the above acrylic acids (for example, acrylamide, n-butyl-acrylamide, t-butyl-acrylamide, diacetone acrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxyethyl methacrylate), methylene bisacrylamide, vinyl esters (for example, vinyl acetate, vinyl propionate and vinyl laurate), acrylonitrile, methacrylonitrile, aromatic vinyl compounds (for example, styrene and derivatives thereof, vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid, maleic acid anhydride, maleic acid esters, N-vinyl-2-pyrrolidone, N-vinylpyridine, 2-vinylpyridine and 4-vinylpyridine, etc. In the present invention, two or more kinds of noncoloring ethylenically unsaturated monomer may be used together. For preferred example, there are combinations of n-butyl acrylate and methyl acrylate, styrene and methacrylic acid, methacrylic aid and acrylamide, and methyl acrylate and diacetone acrylamide, etc.

As is well known in the field of polymer color couplers, the noncoloring ethylenically unsaturated monomer to be copolymerized with the solid water insoluble monomer coupler can be selected so as to have a good influence upon physical properties and/or chemical properties of the formed copolymer, for example, solubility, compatibility with binders in the photographic colloid composition, such as gelatin, elasticity and thermal stability, etc.

The polymer coupler latex may be prepared by previously separating the hydrophilic polymer coupler produced by polymerization of the monomer couplers, and dissolving again in an organic solvent and dispersing the resulted solution to form a latex, or it may be prepared by directly dispersing the solution of the oleophilic polymer coupler obtained by polymerization to form a latex. Alternatively, the polymer coupler latex produced by emulsion polymerization or the layer-structure polymer coupler latex may be added directly to a gelatin-silver halide emulsion.

The polymer coupler latex can be produced by the process described in U.S. Pat. No. 3,451,820 in case of dispersing the oleophilic polymer coupler in an aqueous solution of gelatin to form a latex and by the process described in U.S. Pat. Nos. 4,080,211, 3,370,952, 3,926,436, 3,707,412 and British Pat. No. 1,247,688 in case of adding directly the polymer coupler latex prepared by emulsion polymerization to a gelatin-silver halide emulsion.

These processes can be applied to formation of homopolymers and formation of copolymers.

Free radical polymerization of the ethylenically unsaturated solid monomers is started by adding a free radical formed by thermal decomposition of a chemical initiator, a function of a reducing agent to an oxidative compound (redox initiator) or a physical function, for example, ultraviolet rays, other high energy radiations or high frequency, etc., to a monomer molecule.

Examples of chief chemical initiators include persulfates (ammonium persulfate and potassium persulfate), hydrogen peroxide, 4,4'-azobis(4-cyanovalerianic acid) and the like (which are water soluble), and azobisisobutyronitrile (for example, 2,2'-azobis(2,4-dimethylvaleronitrile), and 2,2'-azobisisobutyronitrile), benzoyl peroxide, chlorobenzoyl peroxide and other compounds (which are water-insoluble).

Examples of conventional redox initiators include hydrogen peroxide-iron (II) salt, potassium persulfate-potassium bisulfate, and cerium salt-alcohol, etc.

Examples of the initiators and functions of them have been described in F. A. Bovey: "Emulsion Polymerization" published by Interscience Publishes, Inc., N.Y., 1955, pages 59–93.

As solvents used for polymerization, it is desired to use those which are not only infinitely compatible with the monomers but also good solvents for the formed polymer couplers, and do not react with the initiator and do not disturb the action of free radical addition polymerization. For example, it is possible to use water, aromatic hydrocarbons (for example, benzene and toluene), hydrocarbons (for example, n-hexane, etc.), alcohols (for example, methanol, ethanol, isopropanol and tert-butanol, etc.), ketones (for example, acetone and methyl ethyl ketone, etc.), cyclic ethers (for example, tetrahydrofuran and dioxane, etc.), esters (for example, ethyl acetate, etc.), chlorinated hydrocarbons (for example, methylene chloride and chloroform, etc.), amides (for example, dimethylformamide and dimethylacetamide, etc.), sulfoxides (for example, dimethylsulfoxide, etc.), nitriles (for example, acetonitrile, etc.) and combinations of them.

Emulsion polymerization of the solid water-insoluble monomer couplers is carried out generally in an aqueous medium or a water/organic solvent medium. As organic solvents used in such case, it is preferred to use those which (1) are substantially inactive to the solid water-insoluble monomer couplers, (2) do not disturb common action of free radical addition polymerization, and (3) have a low boiling point so as to easily remove from the aqueous reaction medium by distillation during polymerization and/or after polymerization. Preferred examples of them include lower alcohols having 1 to 4 carbon atoms (for example, methanol, ethanol and isopropanol), ketones (for example, acetone), chlorinated hydrocarbons (for example, chloroform), aromatic hydrocarbons (for example, benzene), cyclic ethers (for example, tetrahydrofuran), esters (for example, ethyl acetate) and nitriles (for example, acetonitrile), etc.

The polymerization temperature must be established in relation to the molecular weight of the formed polymer or the kind of initiator, etc., and it is possible to use a temperature of less than 0° C. to more than 100° C., but the polymerization is generally carried out in a range of 30° C. to 100° C.

The organic solvent used for dissolving the oleophilic polymer coupler in case of dispersing the oleophilic polymer coupler in an aqueous solution of gelatin to form a latex is then removed before application of the dispersion or by drying the coated dispersion (which is not preferred as much).

As methods for removing the solvent, the solvent having a certain degree of water solubility is removed by washing with water by, for example, the gelatin noodle method or the solvent is removed by spray drying, vacuum or steam purging method.

Further, examples of organic solvents capable of being removed include esters such as lower alkyl ester, lower alkyl ethers, ketones, halogenated hydrocarbons such as methylene chloride or trichloroethylene or fluorinated hydrocarbons, alcohols such as n-butyl alcohol, n-octyl alcohol, and the combinations thereof.

As dispersing agents for dispersing the oleophilic polymer couplers, any type of substance may be used, but ionic surface active agents and, particularly, anionic agents are preferred.

Amphoteric agents such as C-cetylbetaine, N-alkylaminopropionic acid salt or N-alkyliminodipropionic acid salt can be used, too.

On the other hand, as emulsifiers used in case of directly producing the polymer coupler latex by emulsion polymerization, compounds having interface activity are used. Preferred examples of them include soaps, sulfonates, sulfates, cationic compounds, amphoteric compounds and high polymer protective colloids. Examples of them and their functions have been described in Belgische Chemische Industrie, vol. 28, pages 16–20 (1963).

Further, in order to control color shade of the dye formed from a polymer coupler and an oxidation product of an aromatic primary amine developing agent and to improve flexibility of the coated emulsion, permanent solvents, namely, water insoluble organic solvents having a high boiling point (more than 200° C.) may be added.

Further, in order to make the thickness of the final emulsion layer as thin as possible to keep high sharpness, it is desired to reduce the concentration of the permanent solvent.

It is generally preferred that the rate of the coloring portion in the polymer coupler is in a range of 5 to 80% by weight, and it is particularly preferred in a range of 20 to 70% by weight, with respect to color reproduction, coloring properties and stabilizing properties. In this case, the equivalent molecular weight (gram number of the polymer containing 1 mol of monomer coupler) is in a range of about 250 to 4000, but it is not limited to the above described range.

Examples of monomer couplers suitable for producing polymer couplers by polymerization according to the present invention and processes for synthesizing them have been described in various literatures, for example, Belgium Pat. Nos. 584,494, 602,516 and 669,971, British Pat. Nos. 965,503, 1,130,581, 1,247,688 and 1,269,355, U.S. Pat. Nos. 3,356,686, 3,767,412, 4,367,282 and 4,409,320, and Japanese Patent Application (OPI) Nos. 10738/83, 42044/83 and 120252/83.

Further, processes for synthesis and monomers described in Japanese Patent Application No. 95797/82 and 120857/82 (corresponding to U.S. patent application Ser. Nos. 501,725 and 513,181 respectively can be used in the present invention.

Preferred examples are as follows, but the present invention is not limited to them.

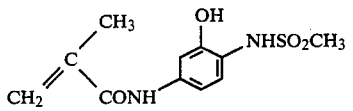
(C-1)

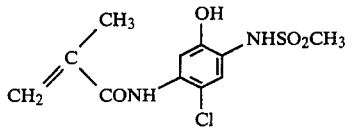
(C-2)

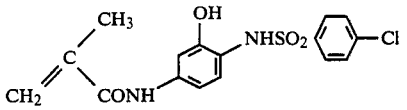
(C-3)

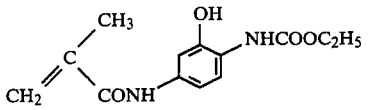
(C-4)

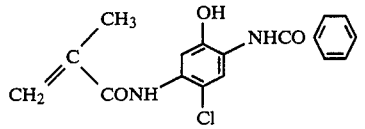
(C-5)

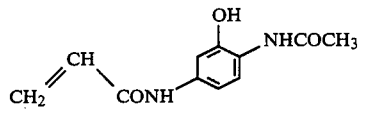
(C-6)

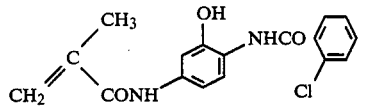
(C-7)

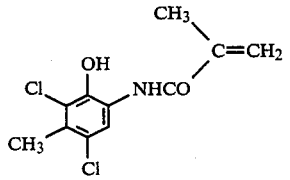
(C-8)

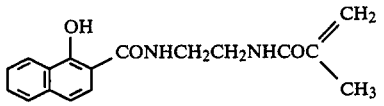
(C-9)

-continued
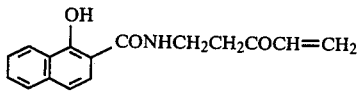
(C-10)
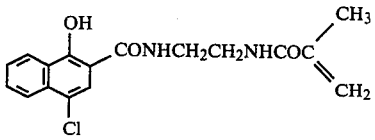
(C-11)
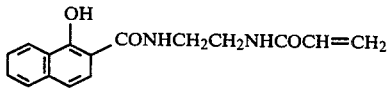
(C-12)
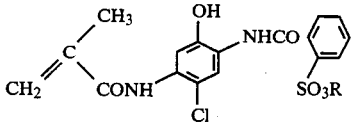
(C-13)
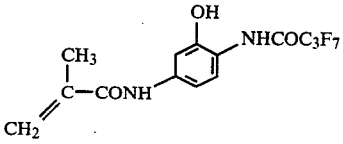
(C-14)
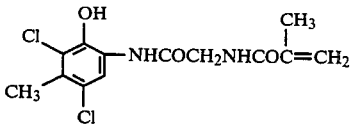
(C-15)
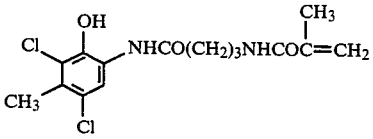
(C-16)
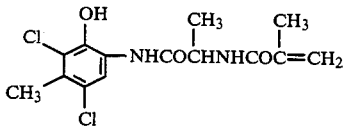
(C-17)
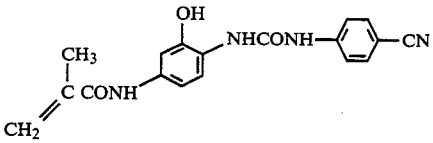
(C-18)
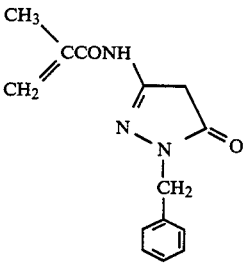
(M-1)
-continued
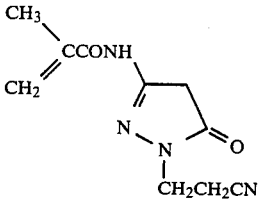
(M-2)
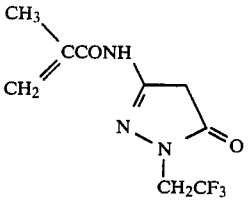
(M-3)
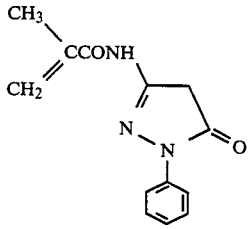
(M-4)
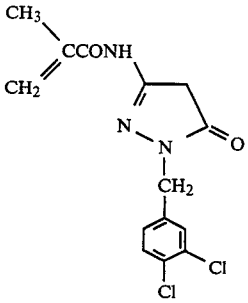
(M-5)
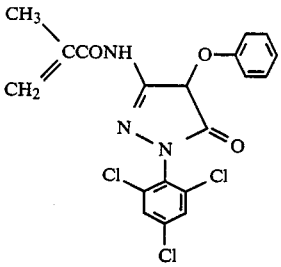
(M-6)
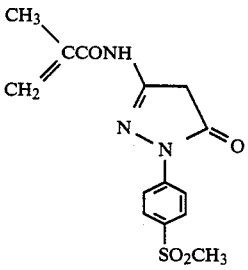
(M-7)

-continued
(M-8)
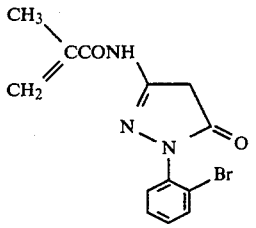
(M-9)
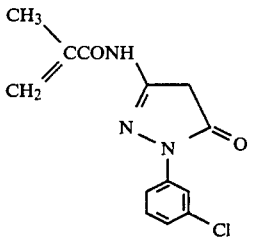
(M-10)
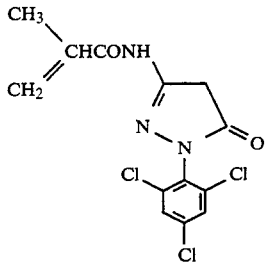
(M-11)
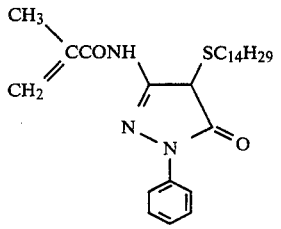
(M-12)
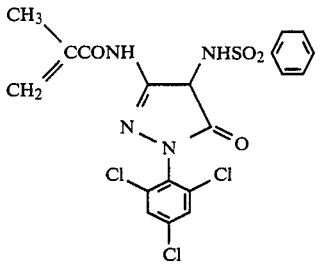
(M-13)
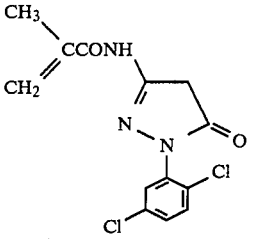
-continued
(M-14)
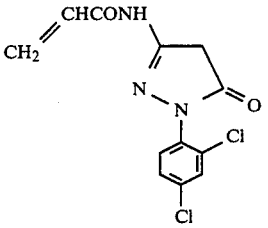
(M-15)
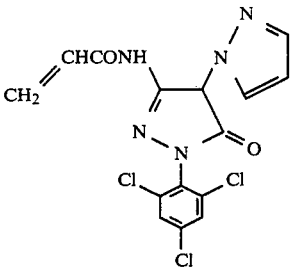
(M-16)
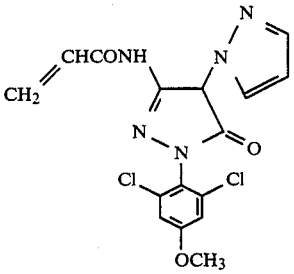
(M-17)
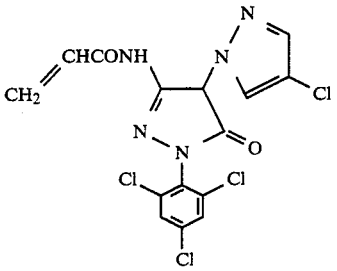
(M-18)
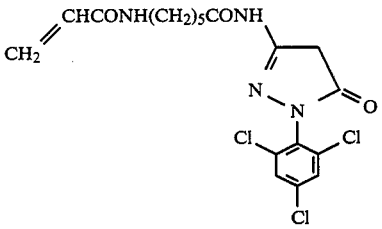
(M-19)
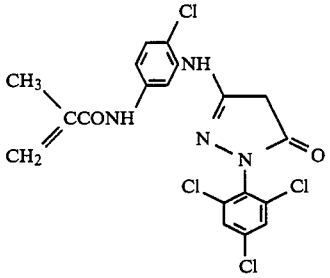

-continued
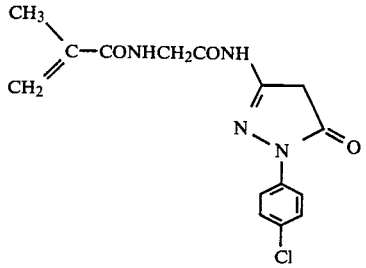
(M-20)
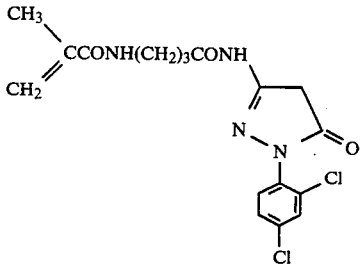
(M-21)
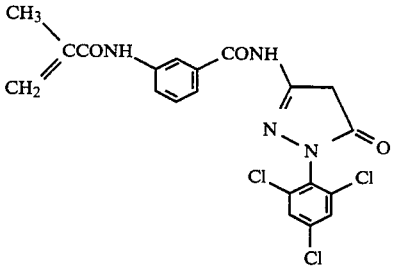
(M-22)
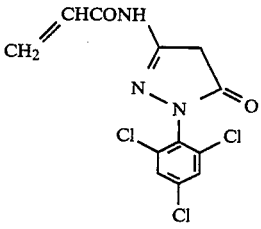
(M-23)
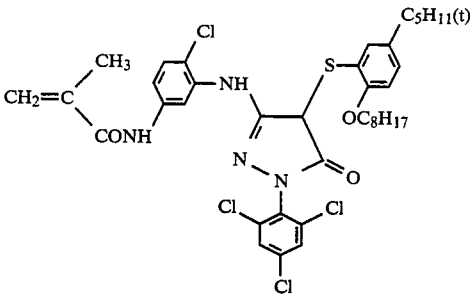
(M-24)
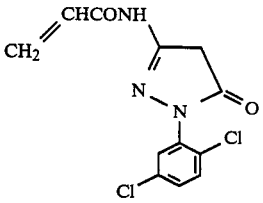
(M-25)
-continued
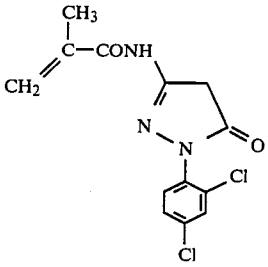
(M-26)
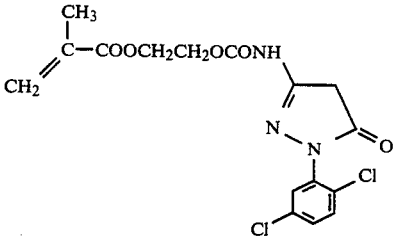
(M-27)
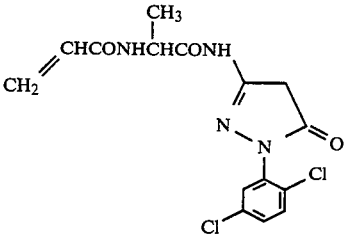
(M-28)
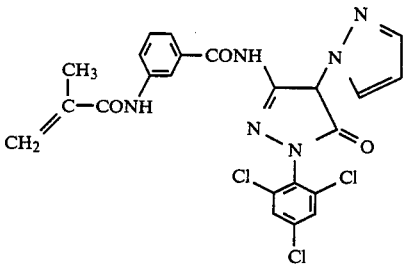
(M-29)
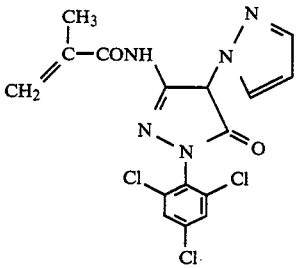
(M-30)
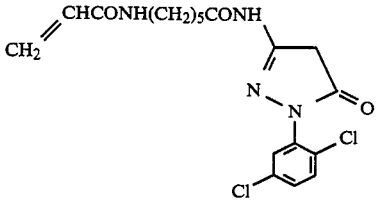
(M-31)

-continued (Y-1)

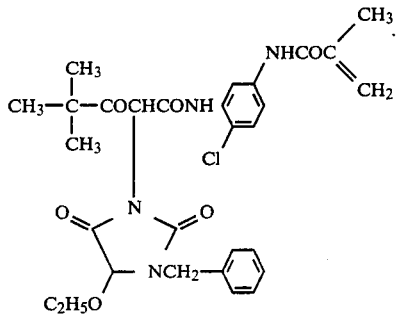

(Y-2)

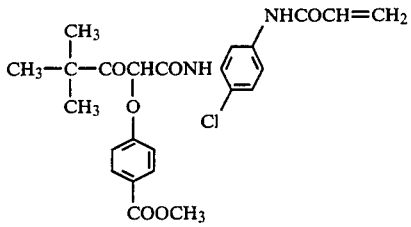

(Y-3)

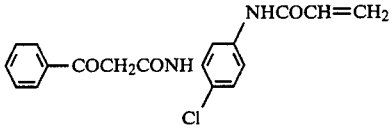

(Y-4)

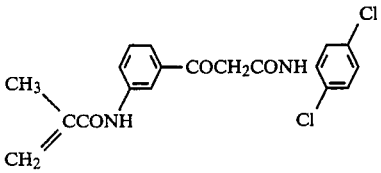

(Y-5)

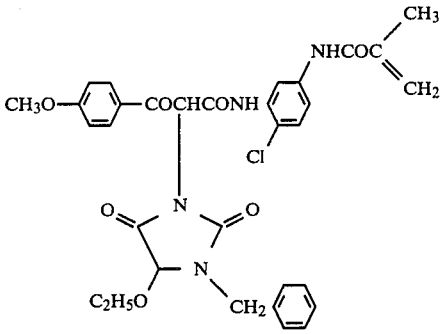

(Y-6)

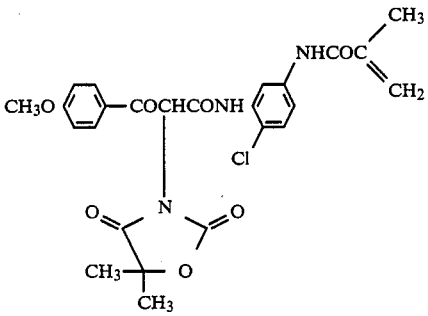

-continued (Y-7)

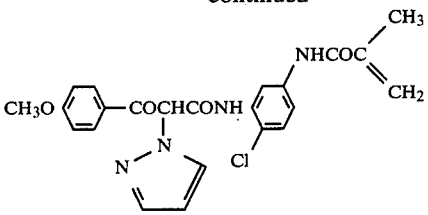

(Y-8)

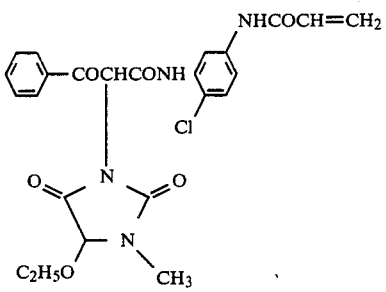

(Y-9)

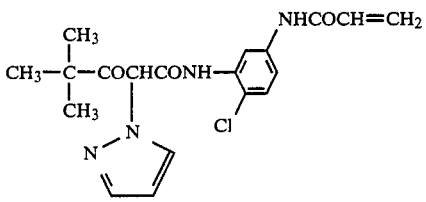

(Y-10)

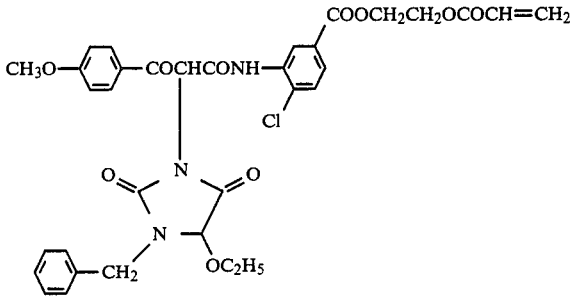

(Y-11)

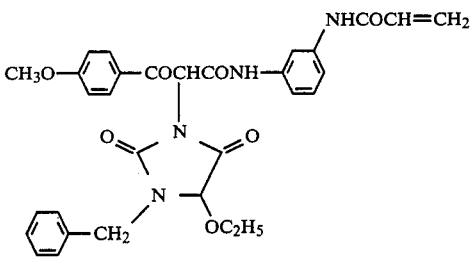

In the following, processes for synthesizing polymer compounds and examples of polymer coupler latexes obtained thereby are illustrated.

PREPARATION EXAMPLE (11)

Polymer coupler latex composed of copolymer of 1-(2,5-dichlorophenyl)-3-methacrylamido-2-pyrazoline-5-one (monomer coupler (M-13)) and n-butyl acrylate. (Latex coupler (A))

2 l of an aqueous solution containing 2 g of sodium salt of oleyl methyltauride was heated to 95° C. under stirring while slowly passing a nitrogen stream therethrough. To the solution, 40 ml of an aqueous solution containing 280 mg of potassium persulfate was added. Then, 20 g of n-butyl acrylate and 20 g of monomer coupler (M-13) were dissolved in 400 ml of ethanol with heating, and the resulting solution was added at intervals of about 30 seconds while preventing separation of crystals.

After addition, the mixture was stirred with heating to 85° to 95° C. for 45 minutes, and, thereafter, 40 ml of an aqueous solution containing 120 mg of potassium persulfate was added thereto. After being allowed to react for 1 hour, ethanol and unreacted n-butyl acrylate were distilled away as an azeotropic mixture of water.

The resulting latex was cooled. After the pH was adjusted to 6.0 with 1N sodium hydroxide, it was filtered. The polymer concentration in the latex was 10.51%. The nitrogen analysis value indicated that the formed copolymer contained 47.6% of the monomer coupler (M-13).

PREPARATION EXAMPLE (12)

Polymer coupler latex composed of copolymer of 1-(2,5-dichlorophenyl)-3-methacryloylamino-2-pyrazoline-5-one (M-13) and n-butyl acrylate. (Latex coupler (B))

270 ml of an aqueous solution containing 1.54 g of sodium salt of oleylmethyltauride was heated to 95° C. under stirring while slowly passing a nitrogen stream therethrough. To this solution, 20 ml of an aqueous solution containing 28 mg of potassium persulfate was firstly added and 2.8 g of n-butyl acrylate was then added. Polymerization was carried out with heating to 85° to 95° C. for about 1 hour under stirring to produce a latex (a). To the latex (a), 14 g of monomer coupler (M-13), 100 ml of methanol and 10 ml of methanol dissolving 14 g of n-butyl acrylate were added. Thereafter, 50 ml of an aqueous solution containing 196 mg of potassium persulfate was added to the resulting mixture, and polymerization was carried out by heating under stirring. After 1 hour, 30 ml of an aqueous solution containing 84 mg of potassium persulfate was added, and subsequently the reaction was carried out for 1 hour and a half. Thereafter, methanol and unreacted n-butyl acrylate were distilled away as an azeotropic mixture of water.

The formed latex was cooled. After the pH was adjusted to 6.0 with 1N sodium hydroxide, it was filtered. The polymer concentration in the latex was 10.2%. The nitrogen analysis value indicated that the formed copolymer contained 43.5% of monomer coupler (M-13).

PREPARATION EXAMPLE (13)

Polymer coupler latex composed of copolymer of 1-(2,5-dichlorophenyl)-3-methacryloylamino-2-pyrazoline-5-one (M-13) and n-butyl acrylate. (Latex coupler (C))

180 ml of an aqueous solution containing 3.5 g of sodium salt of oleyl methyltauride was heated to 95° C. under stirring while slowly passing a nitrogen stream therethrough.

To the solution, 20 ml of an aqueous solution containing 240 mg of potassium persulfate was added. 10 g of monomer coupler (M-13) was dissolved in 60 g of n-butyl acrylate with heating to 140° C., and the mixture was added at intervals of about 30 seconds while preventing separation of crystals.

After addition, the mixture was stirred at 90° to 95° C. for 45 minutes, and 10 ml of an aqueous solution containing 120 mg of potassium persulfate was then added thereto. After being allowed to react for 1 hour, unreacted n-butyl acrylate was distilled away as an azeotropic mixture of water.

The formed latex was cooled and filtered. The polymer concentration in the latex was 26.4%. The nitrogen analysis indicated that the formed copolymer contained 18.5% of the monomer coupler (M-13).

PREPARATION EXAMPLE (14)

Polymer coupler latex composed of copolymer of 1-(2,5-dichlorophenyl)-3-methacryloylamino-2-pyrazoline-5-one (M-13) and ethyl acrylate. (Latex coupler (D))

270 ml of an aqueous solution containing 1.54 g of sodium salt of oleylmethyltauride was heated to 95° C. under stirring while slowly passing a nitrogen stream therethrough. To the solution, 20 ml of an aqueous solution containing 28 mg of potassium persulfate was first added and 2.8 g of ethyl acrylate was then added. The mixture was polymerized with heating to 85° to 95° C. for about 1 hour under stirring to produce a latex (b). Then, to the latex (b), 14 g of monomer coupler (M-13), 100 ml of ethanol and 10 ml of ethanol dissolving 14 g of ethyl acrylate were added. Thereafter, 50 ml of an aqueous solution containing 196 mg of potassium persulfate was added to the resulting mixture, and polymerization was carried out with heating (85° to 95° C.) under stirring. After 1 hour, 30 ml of an aqueous solution containing 84 mg of potassium persulfate was added, and subsequently the reaction was carried out for 1 hour and a half. Thereafter, ethanol and unreacting ethyl acrylate were distilled away as an azeotropic mixture of water.

The formed latex was cooled. After the pH was adjusted to 6.0 with 1N-sodium hydroxide, it was filtered. The polymer concentration in the latex was 10.3%. The nitrogen analysis value indicated that the formed copolymer contained 43.7% of the monomer coupler (M-13).

PREPARATION EXAMPLE (15)

Polymer coupler latex composed of copolymer of 1-(2,5-dichlorophenyl)-3-(2'-acryloylaminopropionoylamino)-2-pyrazoline-5-one (M-28) and n-hexyl acrylate. (Latex coupler (E))

270 ml of an aqueous solution containing 1.54 g of sodium salt of oleyl methyltaurate was heated to 95° C. under stirring while passing a nitrogen stream therethrough. To the solution, 20 ml of an aqueous solution containing 28 mg of potassium persulfate was first added and 2.8 g of n-hexyl acrylate was then added. The mixture was polymerized with heating to 85° to 90° C. for about 1 hour under stirring to produce a latex (c).

Then, to the latex (c), 14 g of monomer coupler (M-28) and 100 ml of ethanol and 10 ml of ethanol dissolving 14 g of n-hexyl acrylate were added. Thereafter, 50 ml of an aqueous solution containing 196 mg of potassium persulfate was added to the resulting mixture, and the mixture was polymerized with heating under stirring. After 1 hour, 30 ml of an aqueous solution containing 84 mg of potassium persulfate was added, and subsequently the reaction was carried out for 1 hour and a half. Thereafter, ethanol and unreacting n-hexyl acrylate were distilled away as an azeotropic mixture of water.

The formed latex was cooled. After the pH was adjusted to 6.0 with 1N sodium hydroxide, it was filtered. The polymer concentration in the latex was 10.3%. The nitrogen analysis value indicated that the formed copolymer contained 45.7% of the monomer coupler (M-28).

PREPARATION EXAMPLE (16)

Polymer coupler latex composed of copolymer of 1-(2,4,6-trichlorophenyl)-3-(3-methacrylamidobenzamido)-4-pyrazolyl-5-oxo-2-pyrazoline (monomer coupler (M-29)) and n-butyl acrylate. (Latex coupler (F))

600 ml of an aqueous solution (distilled water) containing 1.25 g of sodium salt of oleyl methyltauride was heated to 95° C. under stirring while slowly passing a nitrogen stream therethrough.

To the solution 5 ml of an aqueous solution containing 175 mg of potassium persulfate was added.

Then, 20 g of n-butyl acrylate and 5 g of monomer coupler (M-29) were dissolved in 200 ml of a mixed solvent consisting of ethanol and acetonitrile with heating, and the resulting solution was added at intervals of 30 seconds with preventing separation of crystals.

After addition, the mixture was heated to 85° to 95° C. for 45 minutes, and thereafter 3 ml of an aqueous solution containing 75 mg of potassium persulfate was added thereto. After being allowed to react for 1 hour, unreacted n-butyl acrylate and water were distilled away as an azeotropic mixture.

The formed latex was cooled. After the pH was adjusted to 6.0 with 1N sodium hydroxide, it was filtered. The polymer concentration in the latex was 13.7%. The nitrogen analysis indicated that the formed copolymer contained 18.4% of monomer coupler (M-29).

PREPARATION EXAMPLE (17)

Polymer coupler latex composed of copolymer of 1-(2,4,6-trichlorophenyl)-3-methacrylamido-4-pyrazolyl-5-oxo-2-pyrazoline (monomer coupler (M-30)) and n-butyl acrylate. (Latex coupler (G))

600 ml of an aqueous solution (distilled water) containing 1.25 g of sodium salt of oleyl methyltauride was heated to 95° C. under stirring while slowly passing a nitrogen stream therethrough.

To the solution, 5 ml of an aqueous solution containing 280 mg of potassium persulfate was added.

Then, 20 g of n-butyl acrylate and 20 g of monomer coupler (M-30) were dissolved in 200 ml of ethanol with heating, and the resulting solution was added at intervals of about 30 seconds while preventing separation of crystals.

After addition, the mixture was heated to 85° to 95° C. for 45 minutes with stirring. Thereafter, 3 ml of an aqueous solution containing 120 mg of potassium persulfate was added. After being allowed to react for an additional 1 hour, unreacted n-butyl acrylate and water were distilled away as an azeotropic mixture.

The formed latex was cooled. After the pH was adjusted to 6.0 with 1N sodium hydroxide, it was filtered. The polymer concentration in the latex was 9.9%. The nitrogen analysis indicated that the formed copolymer contained 48.9% of the monomer coupler (M-30).

PREPARATION EXAMPLE (18)

Polymer coupler latex composed of copolymer of α-(4-methoxybenzoyl)-α-(1-benzyl-2,4-dioxo-5-ethoxyhydantoin-3-yl)-2-chloro-5-acrylamidoacetanilide (Y-11), n-butyl acrylate and styrene. (Latex coupler (H))

In a 1 l flask, 400 ml of an aqueous solution containing 2.2 g of oleyl methyltauride was heated to 80° C. under stirring while passing a nitrogen stream therethrough, and 2 ml of a 2% solution of potassium persulfate and 4 g of styrene were added to the solution.

After 1 hour, 20 g of monomer coupler (Y-11), 20 g of butyl acrylate and 200 ml of ethanol were added thereto. Thereafter, 14 ml of a 2% solution of potassium persulfate was added and after 1 hour, 6 ml of the same solution was added. After being allowed to further react for 1 hour, unreacted monomers and ethanol were distilled away.

After the formed latex was cooled, it was filtered and the pH of the latex solution was adjusted to 6.0 with 1N NaOH.

The polymer concentration in the formed latex was 10.3%. The nitrogen analysis indicated that 45.7% of monomer coupler (Y-11) was contained in the polymer.

PREPARATION EXAMPLE (19)

Polymer coupler latex composed of copolymer of α-(4-methoxybenzoyl)-α-(1-pyrazolyl)-2-chloro-5-methacryloylaminoacetanilide (Y-7), n-butyl acrylate and ethyl acrylate. (Latex coupler (I))

In a 1 l flask, 400 ml of an aqueous solution containing 5.5 g of sodium salt of oleyl methyltauride was heated to 80° C. under stirring while passing a nitrogen stream therethrough, and 1.5 ml of a 10% solution of sodium 4,4'-azo-bis(4-cyanovalerianate) and 15 g of ethyl acrylate was added to the solution.

After 1 hour, 20 g of monomer coupler (Y-7), 80 g of n-butyl acrylate and 150 ml of ethanol were added thereto. Thereafter, 7 ml of a 10% solution of sodium 4,4'-azo-bis(4-cyanovalerianate) was added, and, after 1 hour, 3 ml of the same solution was added. After being allowed to react for further 1 hour, unreacted monomers and ethanol were distilled away.

After the formed latex was cooled, it was filtered, and the pH of the latex solution was adjusted to 6.0 with 1N NaOH.

The polymer concentration in the formed latex was 29.5%. The nitrogen analysis indicated that 17.2% of monomer coupler (Y-7) was contained in the polymer.

PREPARATION EXAMPLE (20)

Polymer coupler composed of copolymer of 1-(2,4,6-trichlorophenyl)-3-(3-methacrylamidobenzamido)-4-pyrazolyl-5-oxo-2-pyrazoline (monomer coupler (M-29)) and n-butyl acrylate. (Oleophilic polymer coupler-(I))

20 g of monomer coupler (M-29) and 20 g of n-butyl acrylate were added to 150 ml of dioxane and dissolved therein with heating to 85° C. under a nitrogen atmosphere. To the resulting solution, 350 mg of 2,2'-azobis(2,4-dimethylvaleronitrile) dissolved in 10 ml of dioxane was added with stirring. After being heated for about 3 hours, the temperature was raised and the mixture was heated successively at 95° C. for 2 hours. After the solution was cooled to a room temperature, it was poured into 2 l of iced water and precipitated solid was filtered out and sufficiently washed with water.

The resulting solid was dried with heating under a reduced pressure to obtain 39.4 g of oleophilic polymer coupler (I). The nitrogen analysis value of this oleophilic polymer coupler indicated that the formed copolymer contained 48.2% of the monomer coupler (M-29).

In the following, a process for dispersing the oleophilic polymer coupler (I) in an aqueous solution of gelatin to form a latex was illustrated.

First, two solutions (a) and (b) were prepared as follows.

(a) 300 g of a 5.0 wt% aqueous solution of bone gelatin (pH 5.6 at 35° C.) was heated to 32° C., and 12 ml of a 10 wt% aqueous solution of sodium laurylsulfate was added thereto.

(b) 30 g of the oleophilic polymer coupler (I) was dissolved in 60 g of ethyl acetate at 38° C.

Then, the solution (b) was stirred at a high rate in an explosion-proof blender, and the solution (a) was added rapidly thereto. After being stirred for 1 minute, operation of the blender was stopped, and ethyl acetate was removed by reduced-pressure distillation. Thus, the oleophilic polymer coupler was dispersed in the diluted gelatin solution to produce a latex (I').

PREPARATION EXAMPLE (21)

Polymer coupler composed of copolymer of 1-(2,4,6-trichlorophenyl)-3-methacrylamido-4-pyrazolyl-5-oxo-2-pyrazoline (monomer coupler (M-30)) and n-butyl acrylate. (Oleophilic polymer coupler (II))

20 g of monomer coupler (M-30) and 20 g of n-butyl acrylate were added to 150 ml of dioxane and dissolved therein with heating to 85° C. under a nitrogen atmosphere. To the resulting solution, 400 mg of azobisisobutyronitrile dissolved in 10 ml of dioxane was added under stirring. After being allowed to polymerize for 1 hour, 400 mg of azobisisobutyronitrile dissolved in 10 ml of dioxane was additionally added. After being refluxed for about 3 hours with heating, the temperature was raised and the mixture was heated successively at 95° C. for 2 hours.

After the resulting solution was cooled to a room temperature, it was poured into 2 l of iced water, and precipitated solid was filtered out and sufficiently washed with water. Further, the resulting solid was dissolved in ethyl acetate and reprecipitated with n-hexane. The resulting solid was dried with heating under a reduced pressure to obtain 37.8 g of oleophilic polymer coupler (II). The nitrogen analysis value of this oleophilic polymer coupler indicated that the formed copolymer contained 49.2% of mononer coupler (M-30).

In the following, a process for dispersing the oleophilic polymer coupler (II) in an aqueous solution of gelatin to form a latex was illustrated.

First, two solutions (a) and (b) were prepared as follows.

(a) 200 g of a 3.0 wt% aqueous solution of bone gelatin (pH 5.6 at 35° C.) was heated to 38° C., and 16 ml of a 10.0 wt% aqueous solution of sodium lauryl sulfate was added thereto.

(b) 20 g of the oleophilic polymer coupler (II) was dissolved in 200 ml of ethyl acetate at 38° C.

Then, the solution (b) was stirred at a high rate in an explosion-proof blender, and the solution (a) was added rapidly. After being stirred for 1 minute, the operation of the blender was stopped, and ethyl acetate was removed by reduced-pressure distillation. Thus, the oleophilic polymer coupler (II) was dispersed in the diluted gelatin solution to produce a latex (II').

PREPARATION EXAMPLE (22)

Polymer coupler copolymer composed of copolymer of 1-(2,5-dichlorophenyl)-3-methacryloylamino-2-pyrazoline-5-one (monomer coupler (M-13)) and n-butyl acrylate. (Oleophilic polymer coupler (III))

A mixture composed of 20 g of monomer coupler (M-13), 20 g of n-butyl acrylate and 150 ml of dioxane was stirred with heating to 60° C. To the mixture, 350 g of azobisisobutyronitrile dissolved in 10 ml of dioxane was added. After being heated for about 5 hours, the temperature was raised, and the mixture was successively heated to 90° C. for 2 hours. Then, the resulting solution was poured into 2 l of iced water, and the precipitated solid was filtered out and sufficiently washed with water. The resulting solid was dried with heating under a reduced pressure to obtain 38.4 g of oleophilic polymer coupler (III). The nitrogen analysis of this polymer coupler indicated that the formed copolymer contained 52.3% of the monomer coupler (M-13).

In the following, a process for dispersing the oleophilic polymer coupler (III) in an aqueous solution of gelatin to form a latex was illustrated.

First, two solutions (a) and (b) were prepared as follows.

(a) 300 g of a 5 wt% aqueous solution of bone gelatin (pH 5.6 at 35° C.) was heated to 32° C., and 12 ml of a 10 wt% aqueous solution of sodium lauryl sulfate was added thereto.

(b) 20 g of the oleophilic polymer coupler (III) was dissolved in 60 g of ethyl acetate at 38° C.

Then, the solution (b) was put in an explosion-proof blender with stirring at a high rate, and the solution (a) was then added thereto. After being stirred for 1 minute, the operation of the blender was stopped, and ethyl acetate was removed by reduced-pressure distillation. Thus, a latex (III') wherein the oleophilic polymer coupler was dispersed in the diluted gelatin solution was prepared.

PREPARATION EXAMPLE (23)

Polymer coupler composed of copolymer of 1-(2,5-dichlorophenyl)-3-methacryloylamino-2-pyrazoline-5-one (monomer coupler (M-13), methyl acrylate and n-butyl acrylate. (Oleophilic polymer (IV))

A mixture composed of 20 g of monomer coupler (M-13), 10 g of methyl acrylate, 10 g of n-butyl acrylate and 150 ml of dioxane was refluxed with heating under stirring. After 350 mg of azobisisobutyronitrile dissolved in 10 ml of dioxane was added to the mixture, the mixture was refluxed for about 3 hours with heating.

Then, the resulting solution was poured into 2 l of iced water, and precipitated solid was filtered out and sufficiently washed with water. Further, the resulting solid was dissolved in ethyl acetate and reprecipitated with n-hexane. By drying the resulting solid with heating under a reduced pressure, 35.2 g of the oleophilic polymer coupler (IV) was obtained. Nitrogen analysis of the resulting polymer coupler indicated that the formed copolymer contained 51.3% of the monomer coupler (M-13).

In the following, a process for dispersing the oleophilic polymer coupler (IV) in an aqueous solution of gelatin to form a latex was illustrated.

First, two solutions (a) and (b) were prepared as follows.

(a) 200 g of a 3.0 wt% aqueous solution of bone gelatin (pH 5.6 at 35° C.) was heated to 38° C., and 16 ml of a 10 wt% aqueous solution of sodium lauryl sulfate was added thereto.

(b) 20 g of the above described oleophilic polymer coupler (B) was dissolved in 200 ml of ethyl acetate at 38° C.

Then, the solution (b) was put in an explosion-proof blender with stirring at a high rate, and the solution (a) was then added rapidly thereto. After being stirred for 1 minute, the operation of the blender was stopped, and ethyl acetate was removed by reduced-pressure distillation. Thus, the oleophilic polymer coupler was dispersed in the diluted gelatin solution to prepare a latex (IV').

PREPARATION EXAMPLES (24) TO (40)

Using the above described monomer couplers, the following polymer coupler latexes were synthesized according to Preparation Examples (11), (16) and (17).

| Preparation example | Polymer coupler latex | Polymer coupler latex: Kind and amount of monomer coupler | | Polymer coupler latex: Kind and amount of comonomer | | Monomer coupler unit in polymer |
|---|---|---|---|---|---|---|
| 24 | (J) | (C-5) | 10 g | BA | 40 g | 19.7 |
| 25 | (K) | (C-8) | 10 g | MA<br>MAA | 10 g<br>2 g | 51.2 |
| 26 | (L) | (C-8) | 10 g | MA | 10 g | 47.7 |
| 27 | (M) | (C-10) | 10 g | PA | 40 g | 18.9 |
| 28 | (N) | (M-4) | 10 g | EA | 10 g | 50.3 |
| 29 | (O) | (M-9) | 10 g | OA | 20 g | 32.5 |
| 30 | (P) | (M-10)<br>(M-13) | 5 g<br>5 g | BA | 10 g | 50.1 |
| 31 | (Q) | (M-14) | 10 g | EA | 10 g | 51.2 |
| 32 | (R) | (M-15) | 10 g | BA | 20 g | 32.9 |
| 33 | (S) | (M-25) | 10 g | BA<br>MA | 10 g<br>10 g | 50.6 |
| 34 | (T) | (M-26) | 10 g | EHA | 10 g | 49.8 |
| 35 | (U) | (M-28) | 10 g | BA | 10 g | 49.4 |
| 36 | (V) | (M-30) | 10 g | MA | 40 g | 19.5 |
| 37 | (W) | (Y-5) | 10 g | BA | 40 g | 19.6 |
| 38 | (X) | (Y-6) | 10 g | PA | 40 g | 18.9 |
| 39 | (Y) | (Y-8) | 10 g | iBA | 40 g | 19.5 |
| 40 | (Z) | (Y-11) | 10 g | HA | 40 g | 19.7 |

PREPARATION EXAMPLES (41) TO (57)

Using the above described couplers, the following stratified polymer coupler latexes were synthesized according to Preparation Examples (12), (14), (15), (18) and (19) (process described in Japanese Patent Application (OPI) No. 42044/83).

| Preparation example | Stratified polymer coupler latex | Seed Monomer: Kind | Seed Monomer: Amount (g) | Post-adding monomer: Kind | Post-adding monomer: Amount (g) | Post-adding monomer: Kind | Post-adding monomer: Amount (g) | Monomer coupler unit in polymer (% by weight) |
|---|---|---|---|---|---|---|---|---|
| 41 | (AA) | EA | 4 | (M-13) | 20 | EA | 20 | 49.5 |
| 42 | (AB) | BA | 5 | (M-22) | 20 | BA | 80 | 18.3 |
| 43 | (AC) | St | 4 | (M-10) | 20 | BA | 20 | 45.2 |
| 44 | (AD) | BA | 10 | (C-2) | 20 | BA | 80 | 18.0 |
| 45 | (AE) | St | 4 | (C-8) | 20 | EHA | 40 | 30.8 |
| 46 | (AF) | MMA | 5 | (C-9) | 20 | EA | 20 | 41.3 |
| 47 | (AG) | BA | 2 | (M-1) | 20 | BA | 20 | 45.5 |
| 48 | (AH) | BA | 3 | (M-3) | 10 | EA | 10 | 42.8 |
| 49 | (AI) | MA | 3 | (M-9) | 10 | MA | 40 | 18.3 |
| 50 | (AJ) | BMA | 4 | (M-15) | 10 | BA | 40 | 17.5 |
| 51 | (AK) | MMA | 3 | (M-16) | 10 | BA | 20 | 28.5 |
| 52 | (AL) | St | 5 | (M-18) | 10 | EA | 40 | 17.6 |
| 53 | (AM) | BA | 9 | (M-19) | 30 | EHA | 15 | 55.6 |
| 54 | (AN) | BA | 5 | (M-25) | 10 | BA | 10 | 42.7 |
| 55 | (AO) | EA | 5 | (Y-1) | 10 | EHA | 40 | 17.3 |
| 56 | (AP) | BA | 10 | (Y-4) | 20 | BA | 20 | 17.9 |
| 57 | (AQ) | St | 5 | (Y-6) | 20 | MAA | 2 | 40.8 |

PREPARATION EXAMPLES (58) TO (78)

Using the above described monomer couplers, the following oleophilic polymer couplers were synthesized according to Preparation Examples (20), (21), (22) and (23).

| Preparation Example | Oleophilic polymer coupler | Kind and amount of monomer coupler | | Kind and amount of comonomer | | Monomer coupler unit in polymer (% by weight) |
|---|---|---|---|---|---|---|
| 58 | (V) | (C-5) | 10 g | MA | 10 g | 51.3 |
| 59 | (VI) | (C-8) | 10 g | MA | 10 g | 52.1 |
| 60 | (VII) | (C-8) | 10 g | MA<br>MAA | 10 g<br>2 g | 49.7 |
| 61 | (VIII) | (C-8) | 10 g | MA<br>DAAM | 10 g<br>2 g | 47.5 |
| 62 | (IX) | (C-12) | 10 g | BA | 40 g | 19.3 |
| 63 | (X) | (C-14) | 10 g | BA | 20 g | 30.5 |
| 64 | (XI) | (C-15) | 10 g | MA | 10 g | 51.4 |
| 65 | (XII) | (C-15) | 10 g | MA<br>DAAM | 10 g<br>2 g | 48.3 |
| 66 | (XIII) | (C-16) | 10 g | MA | 10 g | 53.1 |
| 67 | (XIV) | (M-4) | 10 g | BA | 10 g | 52.9 |
| 68 | (XV) | (M-13) | 22.5 g | BA | 27.5 g | 44.5 |
| 69 | (XVI) | (M-14) | 10 g | iBA | 10 g | 50.1 |
| 70 | (XVI) | (M-15) | 10 g | BA | 30 g | 25.0 |
| 71 | (XVII) | (M-16) | 10 g | MA | 40 g | 23.5 |
| 72 | (XVIII) | (M-13)<br>(M-23) | 5 g<br>5 g | BA | 10 g | 50.6 |
| 73 | (XIX) | (M-28) | 10 g | OA | 10 g | 47.9 |
| 74 | (XXIV) | (M-13) | 10 g | EA | 10 g | 52.1 |
| 75 | (XX) | (Y-1) | 10 g | BA | 40 g | 19.5 |
| 76 | (XXI) | (Y-5) | 10 g | BA | 40 g | 19.4 |
| 77 | (XXII) | (Y-9) | 10 g | BA | 40 g | 19.7 |
| 78 | (XXIII) | (Y-11) | 10 g | BA | 40 g | 19.2 |

The process for dispersing the hydrophilic polymer couplers in an aqueous solution of gelatin to form a latex can be carried out according to Preparation Examples (20), (21), (22) and (23).

Amounts of monomer couplers and comonomers mean feed amounts for synthesis.

MA: Methyl acrylate
EA: Ethyl acrylate
PA: n-Propyl acrylate
BA: n-Butyl acrylate
iBA: i-Butyl acrylate
HA: n-Hexyl acrylate
OA: n-Octyl acrylate
EHA: 2-Ethylhexyl acrylate
MMA: Methyl methacrylate
BMA: n-Butyl methacrylate
St: Styrene
MAA: Methacrylic acid
DAAM: Diacetone acrylamide As described above, the objects of the present invention are attained by providing color light-sensitive materials in which the above described dye diffusion type coupler and the polymer coupler are used together.

The amount of the dye diffusion type couplers added is in a range of 0.005 mol to 0.2 mol, preferably 0.01 mol to 0.05 mol per mol of silver.

The polymer coupler latex is preferably added in an amount of 0.005 mol to 0.5 mol, more preferably 0.01 to 0.05 mol per mol of silver, on the basis of coupler monomer.

In the present invention, introduction of the dye diffusion type couplers and other conventional couplers into the silver halide emulsion layers can be carried out by known processes, for example, the process described in U.S. Pat. No. 2,322,027. For example, they are dispersed in hydrophilic colloids after being dissolved in alkyl phthalates (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyl laurylamide), aliphatic acid esters (for example, dibutoxyethyl succinate or dioctyl azelate), trimesic acid esters (for example, tributyl trimesate), or organic solvents having a boiling point of about 30° C. to 15° C., such as lower alkyl acetates, ethyl propionate, secondary butyl alcohol, methyl isobutyl ketone, β-ethoxyethyl acetate or methyl cellosolve acetate, etc. The above described high boiling point organic solvents may be blended with lower boiling point solvents.

Further, a process for dispersing using polymers described in Japanese Patent Publication No. 39853/76 and Japanese Patent Application (OPI) No. 59943/76 can be used.

When the couplers have acid groups such as a carboxylic acid group or sulfonic acid group, they are introduced into hydrophilic colloids as an aqueous alkaline solution.

As the binder or protective colloid in the photographic emulsions, gelatin is advantageously used, but other hydrophilic colloids may be used.

As gelatin, not only lime-processed gelatin but also acid-processed gelatin and enzyme-processed gelatin described in Bull. Soc. Sci. Phot. Japan, No. 16, page 30 (1966) may be used. Further, hydrolyzed products and enzymatic decomposition products of gelatin can be used, too. As gelatin derivatives, it is possible to use those which are obtained by reacting gelatin with various compounds such as acid halides, acid anhydrides, isocyanates, bromoacetic acid, alkane sultones, vinyl sulfonamides, maleinimide compounds, polyalkylene oxides or epoxy compounds, etc.

As the gelatin graft polymers, it is possible to use those which are obtained by grafting homo- or copolymer of vinyl monomers such as acrylic acid, methacrylic acid, derivatives thereof as esters or amides, etc., acrylonitrile or styrene, etc. on gelatin. Particularly, it is preferred to use graft polymers composed of gelatin and polymers having a certain degree of compatibility with gelatin, for example, polymers of acrylic acid, methacrylic acid, acrylamide, methacrylamide or hydroxyalkyl methacrylate, etc.

In the photographic emulsion layers of the photographic light-sensitive materials used in the present invention, any of silver bromide, silver iodobromide, silver iodochlorobromide, silver chlorobromide and silver chloride may be used as silver halide. Preferred silver halide is silver iodobromide containing 15% by mol or less of silver iodide. Particularly preferred silver halide is silver iodobromide containing 2% by mol to 12% by mol of silver iodide.

The average particle size (the particle size means diameter in case of spherical or nearly spherical particles and side length in case of cubic particles, which are represented as an average based on projected areas) of silver halide particles in the photographic emulsions is not particularly restricted.

The distribution of particle size may be either narrow or wide.

Silver halide particles in the photographic emulsions may have a regular crystal form such as cube or octahedron. Further, they may have an irregular crystal form such as sphere or tablet, etc. or may have a composite crystal form of them. Particles having various crystal forms may be mixed.

The inner part and the surface layer of silver halide particles may each have a different phase, or the silver halide particles may be composed of a homogeneous phase. Further, they may be particles in which latent images are formed on the surface chiefly or they may be particles in which latent images are formed in the inner part chiefly.

The silver halide particles can be formed by generally known processes, for example, single-jet process or double-jet process.

It is possible to use a process for forming particles in a presence of excess silver ion (the so-called reversal mixing process). As a type of simultaneous mixing process, it is possible to use a process in which the liquid phase forming silver halide is kept at a constant pAg, namely, the so-called controlled double jet process.

According to this process, silver halide emulsions having a regular crystal form and a uniform particle size can be obtained.

Two or more silver halide emulsions produced separately may be blended to use.

Silver halide emulsions are generally chemically sensitized.

Namely, a sulfur sensitization process using sulfur containing compounds capable of reacting with active gelatin (for example, thiosulfates, thioureas, mercapto compounds and rhodanines), a reduction sensitization process using reducing substances (for example, stannous salts, amines, hydrazine derivatives, formamidinesulfinic acid and silane compounds), and a noble metal sensitization process using noble metal compounds (for example, gold complex salts and complex salts of metals of group VIII in the periodic table such as Pt, Ir or Pt, etc.) can be used alone or as a combination of them.

To the photographic emulsions used in the present invention, it is possible to add various compounds in order to prevent fogging in the process of producing photographic light-sensitive materials, during preservation thereof or during photographic processing or to stabilize photographic properties.

The photographic emulsion layers and other hydrophilic colloid layers of the photographic light-sensitive materials prepared by the present invention may contain various surface active agents for various purposes, for example, as coating aids or for prevention of electrification, improvement of lubricating property, emulsifying dispersion, prevention of adhesion and improvement of photographic properties (for example, development acceleration, hardening of tone and sensitization), etc.

In the photographic light-sensitive materials prepared by the present invention, the photographic emulsion layers and other hydrophilic colloid layers may contain dispersions of water-insoluble or poorly soluble synthetic polymers for the purpose of improving dimensional stability. For example, it is possible to use polymers composed of one or more monomer components selected from alkyl acrylates, alkyl methacrylates, alkoxyalkyl acrylates, alkoxyalkyl methacrylates, glycidyl acrylates, glycidyl methacrylate, acrylamides, methacrylamides, vinyl esters (for example, vinyl acetate), acrylonitrile, olefins and styrene, or polymers composed of the above described monomer components and acrylic acid, methacrylic acid, $\alpha,\beta$-unsaturated dicarboxylic acid, hydroxyalkyl acrylates, hydroxyalkyl methacrylates, sulfoalkyl acrylates, sulfoalkyl methacrylates or styrenesulfonic acid, etc.

In order to carry out photographic processing of the layers composed of the photographic emulsions prepared in the present invention, it is possible to utilize known processes and known processing solutions, as described in, for example, *Research Disclosure,* No. 176, pages 28 to 30 (RD-17643). The photographic processing may be that of forming dye images (color photographic processing) according to the purpose. The processing temperature is generally selected from 18° C. to 50° C., but a temperature of less than 18° C. and a temperature of more than 50° C. may be used.

As fixing solutions, those having a composition conventionally used can be used. As fixing agents, it is possible to not only thiosulfates and thiocyanates but also organic sulfur compounds which are known to have an effect as fixing agents. The fixing solution may contain water soluble aluminium salts as a hardener.

When forming dye images, conventional processes can be applied. For example, there is a negative-positive process (described in, for example, "Journal of the Society of Motion Picture and Television Engineers", Vol. 61 (1953), pages 667–701).

The color developing solution generally consists of an aqueous alkaline solution containing a color developing agent. As the color developing agents, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline and 4-amino-3-methyl-N-ethyl-N-$\beta$-methoxyethylaniline, etc.).

In addition, those described in L. F. A. Mason: Photograpic Processing Chemistry (Focal Press, 1966), pages 226–229, U.S. Pat. Nos. 2,193,015 and 2,592,364, and Japanese Patent Application (OPI) No. 64933/73 may be used.

The color developing solution may contain pH buffer agents, development inhibitors and antifogging agents, etc. in addition to the above described agents. It may contain, if necessary, water softeners, preservatives, organic solvents, development accelerators, dye forming couplers, competitive couplers, fogging agents, auxiliary developing agents, viscosity increasing agents, polycarboxylic acid chelating agents and antioxidants, etc.

The present invention will be explained in greater detail with reference to the following examples, but the present invention should not be construed as being limited thereto.

EXAMPLE 1

A multilayer color photographic light-sensitive material composed of layers having the following compositions provided on a cellulose triacetate film support was prepared.

The 1st layer: Antihalation layer
- A gelatin layer containing black colloidal silver.

The 2nd layer: Intermediate layer
- A gelatin layer containing an emulsified dispersion of 2,5-di-t-octylhydroquinone.

The 3rd layer: Red-sensitive low-speed emulsion layer
- Silver iodobromide emulsion (silver iodide: 5% by mol, average particle size: 0.5μ): silver coating amount 1.79 g/m$^2$
- Sensitizing dye I: $6\times10^{-5}$ mol per mol of silver
- Sensitizing dye II: $1.5\times10^{-5}$ mol per mol of silver
- Coupler A: 0.06 mol per mol of silver
- Coupler C: 0.003 mol per mol of silver
- Coupler D: 0.003 mol per mol of silver
- Tricresyl phosphate coating amount 0.3 ml/m$^2$ The 4th layer: Red-sensitive high-speed emulsion layer
- Silver iodobromide emulsion (silver iodide: 4% by mol, average particle size: 0.7μ): silver coating amount 1.4 g/m$^2$
- Sensitizing dye I: $3\times10^{-5}$ mol per mol of silver
- Sensitizing dye II: $1.2\times10^{-5}$ mol per mol of silver
- Coupler F: 0.0125 mol per mol of silver
- Coupler C: 0.0016 mol per mol of silver
- Tricresyl phosphate: coating amount 0.2 ml/m$^2$ The 5th layer: Intermediate layer
- The same as the 2nd layer.

The 6th layer: Green-sensitive low-speed emulsion layer
- Silver iodobromide emulsion (silver iodide: 4% by mol, average particle size: 0.5μ) silver coating amount 1.0 g/m$^2$
- Sensitizing dye III: $3\times10^{-5}$ mol per mol of silver
- Sensitizing dye IV: $1\times10^{-5}$ mol per mol of silver
- Coupler B: 0.08 mol per mol of silver
- Coupler M: 0.008 mol per mol of silver
- Coupler D: 0.0015 mol per mol of silver
- Tricresyl phosphate: coating amount 1.4 ml/m$^2$ The 7th layer: Green-sensitive high-speed emulsion layer
- Silver iodobromide emulsion (silver iodide: 5% by mol, average particle size: 0.75μ): silver coating amount 1.6 g/m$^2$
- Sensitizing dye III: $2.5\times10^{-5}$ mol per mol of silver
- Sensitizing dye IV: $0.8\times10^{-5}$ mol per mol of silver
- Coupler B: 0.02 mol per mol of silver
- Coupler M: 0.003 mol per mol of silver
- Tricresyl phosphate: coating amount 0.3 ml/m$^2$ The 8th layer: Yellow filter layer
- A gelatin layer composed of an aqueous solution of gelatin containing yellow colloidal silver and an emulsified dispersion of 2,5-di-t-octylhydroquinone.

The 9th layer: Blue-sensitive low-speed emulsion layer
- Silver iodobromide emulsion (silver iodide: 6% by mol, average particle size: 0.7μ): silver coating amount 0.5 g/m$^2$
- Coupler Y: 0.125 mol per mol of silver
- Tricresyl phosphate: coating amount 0.3 ml/m$^2$ The 10th layer: Blue-sensitive high-speed emulsion layer
- Silver iodobromide emulsion (silver iodide: 6% by mol, average particle size: 0.8μ): silver coating amount 0.6 g/m$^2$
- Coupler Y: 0.04 mol per mol of silver
- Tricresyl phosphate: coating amount 0.1 ml/m$^2$ The 11th layer: Protective layer
- A gelatin layer containing trimethyl methacrylate particles (diameter: about 1.5μ)

The couplers in each layer were used as emulsions which were prepared by adding the coupler in a solution of tricresyl phosphate and ethyl acetate, adding sodium p-dodecylbenzenesulfonate as an emulsifier, heating to dissolve the coupler, thereafter blending it with a 10% gelatin solution heated, and emulsifying in a colloid mill.

To each layer, gelatin hardeners and surface active agents were added in addition to the above described compositions.

The sample prepared as described above was used as Sample 101.

Compounds used for producing the sample:

Sensitizing dye I: Anhydro-5,5'-dichloro-3,3'-di(γ-sulfopropyl)-9-ethyl-thiacarbocyanine hydroxide.-pyridinium salt Sensitizing dye II: Anhydro-9-ethyl-3,3'-di(γ-sulfopropyl)-4,5,4',5'-dibenzothiacarbocyaninehydroxide.-triethylamine salt Sensitizing dye III: Anhydro-9-ethyl-5,5'-dichloro-3,3'-di(γ-sulfopropyl)oxacarbocyanine.sodium salt Sensitizing dye IV: Anhydro-5,6,5',6'-tetrachloro-1,1'-diethyl-3,3'-di{β-[β-(γ-sulfopropoxy)ethoxy]ethyl-}imidazolocarbocyanine hydroxide sodium salt

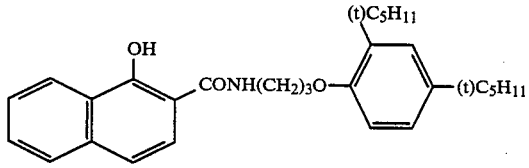

Coupler A

-continued
Coupler B
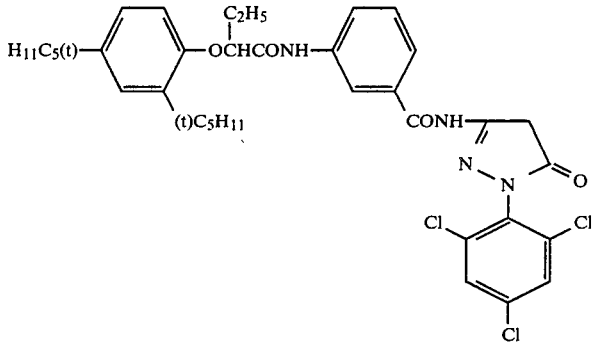
Coupler C
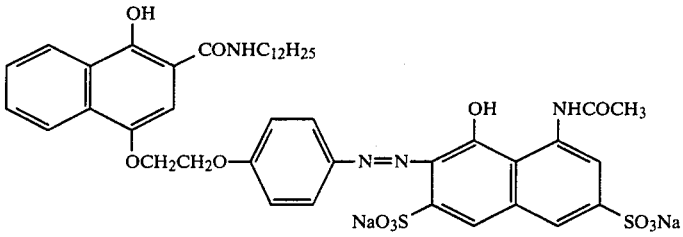
Coupler D
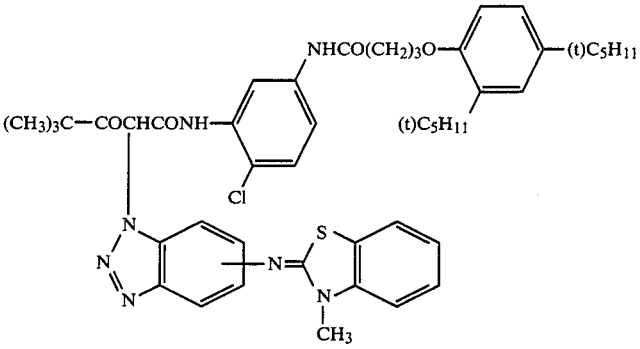
Coupler E
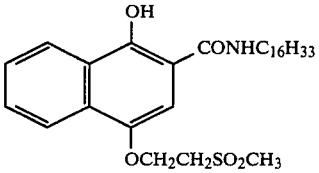
Coupler M
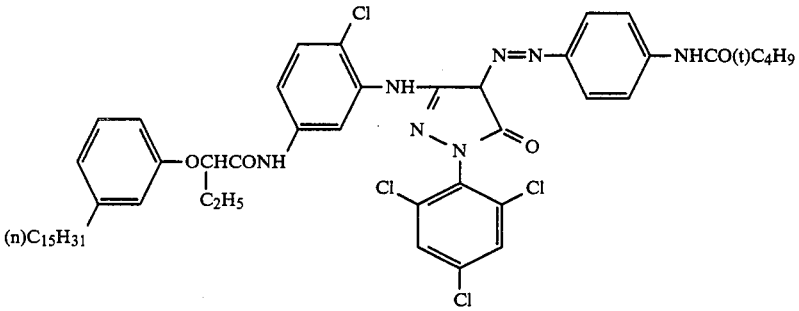

-continued

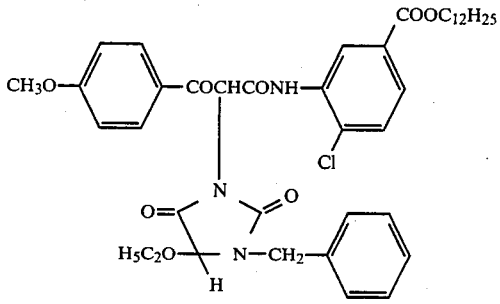

Coupler Y

Samples 102 to 107 were prepared by the same manner as in Sample 101, except that Coupler B in the 6th layer and the 7th layer of Sample 101 was changed as shown in Table 1.

In Samples 103 to 107 using polymer couplers, the amount of tricresyl phosphate was 1/10 of the Sample 101.

The resulting Samples 101 to 107 were exposed to white light through a pattern for measuring graininess or a pattern for measuring sharpness, and then subjected to the following development processing.

The development processing was carried out at 38° C. as follows.

| | |
|---|---|
| 1. Color development | 3 minutes and 15 seconds |
| 2. Bleach | 6 minutes and 30 seconds |
| 3. Water wash | 3 minutes and 15 seconds |
| 4. Fix | 6 minutes and 30 seconds |
| 5. Water wash | 3 minutes and 15 seconds |
| 6. Stabilization | 3 minutes and 15 seconds |

Compositions of the processing solutions used in each process are as follows.

| | |
|---|---|
| Color Development Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methyl aniline sulfate | 4.5 g |
| Water to make | 1 l |
| Bleaching Solution: | |
| Ammonium bromide | 160.0 g |
| Aqueous ammonia solution (28%) | 25.0 g |
| Ethylenediaminetetraacetato sodium iron salt | 130.0 g |

-continued

| | |
|---|---|
| Glacial acetic acid | 14 ml |
| Water to make | 1 l |
| Fixing Solution: | |
| Sodium tetrapolyphosphate | 2.0 g |
| Sodium sulfite | 4.0 g |
| Ammonium thiosulfate (70%) | 175.0 g |
| Sodium bisulfite | 4.6 g |
| Water to make | 1 l |
| Stabilizing Solution: | |
| Formalin | 8 ml |
| Water to make | 1 l |

Graininess and sharpness of magenta images in these processed samples were carried out.

The graininess was evaluated by the conventional RMS (Root Mean Square) method. Evaluation of the granularity by the RMS method is well known in persons skilled in the art, which has been described in "Photographic Science and Engineering", Vol. 19, No. 4, (1975), pages 235–238 as the title "RMS Granularity; Determination of Just Noticeable Difference".

Further, the sharpness was evaluated as a MTF value.

In Table 1, RMS values in the density 0.5 and 1.0 and MTF values in the frequency of 20 per mm are shown.

TABLE 1

| Sample | The 6th layer Magenta coupler (amount added) | The 7th layer Magenta coupler | RMS value D = 0.5 | RMS value D = 1.0 | MTF value (20/mm) |
|---|---|---|---|---|---|
| 101 (Comparative example) | B (1) | B | 0.045 | 0.030 | 0.67 |
| 102 (Comparative example) | B (1) | BM-3 | 0.029 | 0.026 | 0.54 |
| 103 (Comparative example) | XV (0.8) | B | 0.045 | 0.032 | 0.78 |
| 104 (This invention) | XV (0.8) | BM-3 | 0.030 | 0.027 | 0.73 |
| 105 (This invention) | XIV (0.5) | BM-3 | 0.030 | 0.027 | 0.74 |
| 106 (This invention) | XV (0.8) | BM-4 | 0.27 | 0.026 | 0.72 |
| 107 (This invention) | XV (0.8) | BM-5 | 0.032 | 0.028 | 0.75 |

Amount in the 6th layer means a ratio of the mole number of the coloring unit portion in the polymer coupler based on the mole number of Coupler B in Sample 101 being 1.

The amount of couplers in the 7th layer is equal to the mole number in Sample 101.

As is shown in the table, when the organic solvent is present in a large amount in the 6th layer, the effect of improving graininess caused by using the dye diffusion type couplers is great, but sharpness remarkably deteriorates at the same time. On the contrary, in samples of the present invention, it is obvious that both graininess and sharpness are remarkably improved as compared with Sample 101.

EXAMPLE 2

Samples 108 to 112 were prepared by the same manner as in Sample 101 of Example 1, except that Coupler A and Coupler F in the 3rd layer and the 4th layer of Sample 101 were changed as shown in Table 2.

In Samples 110 to 112 using polymer couplers, the amount of tricresyl phosphate was 1/10 of Sample 101.

The resulting samples were exposed to light and processed by the same manner as in Example 1, and graininess and sharpness of cyan images were measured.

Results are shown in Table 2.

TABLE 2

| Sample | The 3rd layer Cyan coupler | The 4th layer Cyan coupler | RMS value D = 0.5 | RMS value D = 1.0 | MTF value (20/mm) |
|---|---|---|---|---|---|
| 101 (Comparative Example) | A | F | 0.055 | 0.045 | 0.46 |
| 108 (Comparative Example) | A | BC-2 | 0.040 | 0.035 | 0.40 |
| 109 (Comparative Example) | X | F | 0.055 | 0.046 | 0.52 |
| 110 (This Invention) | X | BC-2 | 0.040 | 0.036 | 0.45 |
| 111 (This Invention) | X | BC-7 | 0.050 | 0.040 | 0.47 |
| 112 (This Invention) | X | BC-8 | 0.037 | 0.032 | 0.43 |

Graininess and sharpness of Samples of the present invention are remarkably improved as compared with Sample 101.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material, comprising:

a support having thereon;

a silver halide emulsion layer containing a non-polymeric, non-diffusion coupler which couples with an oxidation product of a developing agent during development processing to form a dye of such mobility that controlled image smearing occurs; and;

a silver halide emulsion layer containing a polymer coupler latex, the silver halide emulsion layer containing the polymer coupler latex being adjacent to the silver halide emulsion layer containing the non-polymeric, non-diffusion coupler.

2. A silver halide color photographic light-sensitive material as claimed in claim 1, wherein the non-polymeric, non-diffusion coupler is represented by general formula (B):

$$(Cp\rightarrow)X_a \qquad (B)$$

wherein Cp represents a coupler group capable of diffusion which forms a dye of such mobility that controlled color image smearing occurs to improve graininess, X represents a group which bonds to a coupling position of the coupler group and is released by a reaction with an oxidation product of a color developing agent, which is a group containing a ballast group having 8 to 31 carbon atoms, and a represents 1 or 2.

3. A silver halide color photographic light-sensitive material as claimed in claim 2, wherein the non-polymeric, non-diffusion coupler is a compound selected from the group consisting of compounds represented by the general formulae (I) and (II):

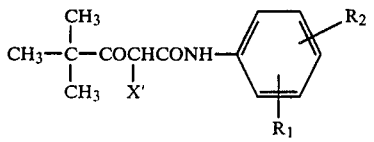

(I)

(II)

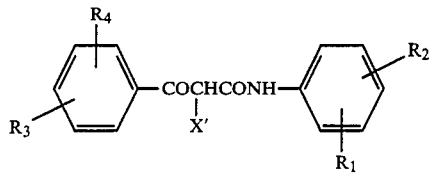

wherein $R_1$, $R_2$, $R_3$ and $R_4$ independently represent hydrogen, a halogen atom, an alkyl group, an alkoxy group, an aryloxy group, an acylamino group, a sulfonamido group, a carbamoyl group, a sulfamoyl group, an alkylthio group, an alkylsulfonyl group, an alkoxycarbonyl group, a ureido group, a cyano group, a carboxyl group, a hydroxy group or a sulfo group, and further wherein the total of carbon atoms in $R_1$, $R_2$, $R_3$ and $R_4$ is 10 or less, and X' represents the group having the ballast group.

4. A silver halide color photographic light-sensitive material as claimed in claim 3, wherein, $R_1$, $R_2$, $R_3$ and $R_4$ represent a hydrogen atom, a halogen atom, a methyl group, an ethyl group, an isopropyl group, a hydroxyethyl group, a methoxy group, an ethoxy group, a methoxyethoxy group, a phenoxy group, an acetylamino group, a trifluoroacetylamino group, a methanesulfonamido group, a benzenesulfonamido group, a carbamoyl group, a sulfamoyl group, an alkylthio group, an alkylsulfonyl group, an alkoxycarbonyl group, a ureido group, a cyano group, a carboxyl group, a hydroxy group or a sulfo group.

5. A silver halide color photographic light-sensitive material as claimed in claim 3, wherein X' is a group selected from the group consisting of groups represented by the general formulae (III) and (IV):

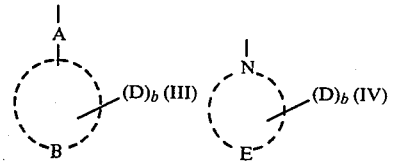

wherein A represents an oxygen atom or a sulfur atom, B represents a group of non-metal atoms necessary to form an aryl ring or a hetero ring, E represents a group of non-metal atoms necessary to form a 5-membered or 6-membered heterocyclic ring together with the nitrogen atom, which rings may be fused with another aryl ring or heterocyclic ring, D represents a ballast group, which may contain linking groups such as —O—, —S—, —COO—, —CONH—, —$SO_2$NH—, —NHCONH—, —$SO_2$—, —CO— or —NH—, and b represents a positive integer.

6. A silver halide color photographic light-sensitive material as claimed in claim 2, wherein the non-polymeric, non-diffusion coupler is a compound selected from the group consisting of compounds represented by the general formulae (V), (VI) and (VII):

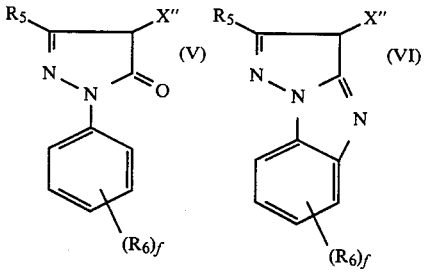

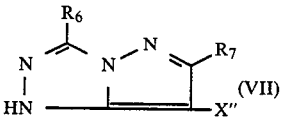

wherein $R_5$ is an amido group, an anilino group, or a ureido group, $R_6$ and $R_7$ are a hydrogen atom, an alkyl group, an alkoxy group, an acylamido group, an alkoxycarbonyl group, a N-alkylcarbamoyl group, a ureido group, a cyano group, an aryl group, a N,N-dialkylsulfamoyl group, a nitro group, a hydroxy group, a carboxyl group or an aryloxy group, and f is an integer of 0 to 4, and further wherein the total of carbon atoms in $R_5$ and $(R_6)_f$ in the general formulae (V) and (VI) and that in $R_6$ and $R_7$ in the general formula (VII) are not beyond 10, and X″ represents the group having the ballast group.

7. A silver halide color photographic light-sensitive material as claimed in claim 6, wherein $R_5$ represents a propanamido group, a benzamido group, a 2-chloroanilino group, a 5-acetamidoanilino group, a phenyl ureido group or a butaneureido group, $R_6$ and $R_7$ represent each a halogen atom, a methyl group, an ethyl group, a methoxy group, an ethoxy group, an acetamido group, a benzamido group, a methoxycarbonyl group, a N-methylcarbamoyl group, a N-methylureido group, a cyano group, a phenyl group, a naphthyl group, a N,N-dialkylsulfamoyl group, a nitro group, a hydroxy group, a carboxyl group or an aryloxy group.

8. A silver halide color photographic light-sensitive material as claimed in claim 6, wherein X″ is a group selected from the group consisting of groups represented by the general formulae (VIII), (IX) and (X):

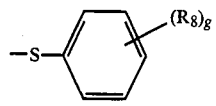

(VIII)

—S—$R_8$ (IX)

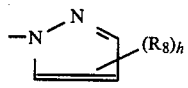

(X)

wherein g is an integer of 1 to 5, h is 0 or an integer of 1 to 3 and, $R_8$ represents a ballast group selected from a group consisting of a substituted or unsubstituted alkyl group, an aralkyl group, an alkenyl group, an unsubstituted or substituted aryl group or a cycloalkyl group.

9. A silver halide color photographic light-sensitive material as claimed in claim 8, wherein $R_8$ represents a butyl group, a dodecyl group, a benzyl group, an allyl group, a phenyl group, or a cyclopentyl group.

10. A silver halide color photographic light-sensitive material as claimed in claim 8, wherein the substituents of $R_8$ are selected from a halogen atom, an alkoxy group, an acylamido group, an alkoxycarbonyl group, an N-alkylcarbamoyl group, a ureido group, a cyano group, an aryl group, a nitro group, an alkylthio group, an alkylsulfinyl group, an alkylsulfonyl group, an anilino group, a sulfonamido group, an N-alkyl sulfamoyl group, an aryloxy group and an acyl group.

11. A silver halide color photographic light-sensitive material as claimed in claim 2, wherein the non-polymeric, non-diffusion coupler is a compound selected from the group consisting of compounds represented by the general formulae (XI) and (XII):

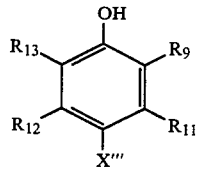

(XI)

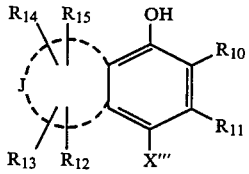

(XII)

wherein $R_9$ is a hydrogen atom, an aliphatic group having 10 or fewer carbon atoms, an alkoxy group having 10 or fewer carbon atoms, an aryloxy group, or an acylamido group, a sulfonamido group or ureido group represented by the general formulae (XIII) to (XV) respectively or a carbamoyl group represented by the following general formula (XVI):

—NH—CO—G (XIII)
—NH—$SO_2$—G (XIV)
—NHCONH—G (XV)

-continued

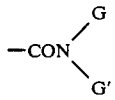

(XVI)

wherein G and G' independently represent a hydrogen atom, an aliphatic group having 1 to 12 carbon atoms, a cycloalkyl group or an aryl group; $R_{10}$ represents a hydrogen atom, an aliphatic group having 12 or fewer carbon atoms or a carbamoyl group represented by the general formula (XVI), and $R_{11}$, $R_{12}$, $R_{13}$, $R_{14}$ and $R_{15}$ independently represent a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group; J represents non-metal atoms necessary to form a 5- or 6-membered ring and X''' represents the group having the ballast group.

12. A silver halide color photographic light-sensitive material as claimed in claim 11, wherein $R_9$ is a group selected from a hydrogen atom, a methyl group, an isopropyl group, an amyl group, a cyclohexyl group, an octyl group, a methoxy group, an isopropoxy group, a pentadecyloxy group, a phenoxy group, a p-tert-butylphenoxy group, an acylamido group, a sulfonamido group, a ureido group and a carbamoyl group and G and G' independently represent a group selected from a hydrogen atom, a straight or branched alkyl group having 4 to 10 carbon atoms, a cyclopropyl group, a cyclohexyl group, a norbonyl group, a phenyl group and a naphthyl group.

13. A silver halide color photographic light-sensitive material as claimed in claim 12, wherein the alkyl groups and aryl groups are substituted by a halogen atom, a nitro group, a cyano group, a hydroxyl group, a carboxy group, an amino group, an alkyl group, an aryl group, an alkoxycarbonyl group, an acyloxycarbonyl group, an amido group, an imido group, a carbamoyl group, a sulfamoyl group, an alkoxy group, or an aryloxy group.

14. A silver halide color photographic light-sensitive material as claimed in claim 11, wherein $R_{11}$, $R_{12}$, $R_{13}$, $R_{14}$ and $R_{15}$ are each selected from a hydrogen atom, chlorine, bromine, a primary, secondary and tertiary alkyl group having 1 to 12 carbon atoms, an alkoxy group, an octylthio group, a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, a benzofuranyl group, a furanyl group, a thiazolyl group, a benzothiazolyl group, a naphthothiazolyl group, an oxazolyl group, a benzoxazolyl group, a naphthoxazolyl group, a pyridyl group, a quinolynyl group, an amino group, a methylamino group, a diethylamino group, a dodecylamino group, a phenylamino group, a tolylamino group, a 4-cyanophenylamino group, a 2-trifluoromethylphenylamino group, a benzothiazolamino group, an alkylcarbonamido group, an arylcarbonamido group, a heterocyclic carbonamido group, an alkylsulfonamido group, an arylsulfonamido group, a heterocyclic sulfonamido group, an alkylsufamoyl group, an arylsulfamoyl group, a heterocyclic sulfamoyl group, an alkylcarbamoyl group, an arylcarbamoyl group and a heterocyclic carbamoyl group.

15. A silver halide color photographic light-sensitive material as claimed in claim 11, wherein J represents non-metal atoms necessary to form a benzene ring, a cyclohexene ring, a cyclopentene ring, a thiazole ring, an oxazole ring, an imidazole ring, a pyridine ring or a pyrrole ring.

16. A silver halide color photographic light-sensitive material as claimed in claim 11, wherein X''' represents a group which bonds to a coupling position through —O—, —S— or —N=N— thereof.

17. A silver halide color photographic light-sensitive material as claimed in claim 11, wherein X''' represents an alkoxy, aryloxy, alkylthio or arylthio group having 8 to 32 carbon atoms.

18. A silver halide color photographic light-sensitive material as claimed in claim 17, wherein the groups contain

—O—, —S—, —NH—, —CONH—, —COO—, —$SO_2$NH—,

—SO—, —$SO_2$—, —CO—, —NH$\overset{O}{\overset{\|}{C}}$NH— or 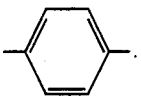 .

19. A silver halide color photographic light-sensitive material as claimed in claim 18, wherein the group further contains —COOH, —$SO_3$H, —OH or —$SO_2NH_2$.

20. A silver halide color photographic light-sensitive material as claimed in claim 1, wherein the non-polymeric, non-diffusion coupler is present in an amount in the range of 0.005 mol to 0.2 mol per mol of silver and the polymer coupler latex is present in an amount in the range of 0.005 mol to 0.5 mol per mol of silver.

21. A silver halide color photographic light-sensitive material as claimed in claim 20, wherein the non-polymeric, non-diffusion coupler is present in an amount in the range of 0.01 mol to 0.05 mol per mol of silver and the polymer coupler latex is present in an amount in the range of 0.01 to 0.05 mol per mol of silver.

22. A silver halide color photographic light-sensitive material as claimed in claim 1, wherein the polymer coupler latex contains a polymer having a recurring unit represented by the general formula (CII) derived from a monomer coupler represented by the following general formula (CI) or a copolymer of the above described monomer coupler and one or more noncoloring monomers containing at least one ethylene group which do not have an ability of coupling by oxidation with an aromatic primary amine developing agent, $$CH_2{=}\overset{R}{\overset{|}{C}}{-}(J)_m{-}(K)_n{-}L{-}Q \qquad \text{(CI)}$$

$$\left(CH_2{-}\underset{\underset{(J)_m{-}(K)_n{-}L{-}Q}{|}}{\overset{R}{\overset{|}{C}}}\right) \qquad \text{(CII)}$$

wherein R represents a hydrogen atom, a lower alkyl group having 1 to 4 carbon atoms or a chlorine atom, L represents —CONH—, —NHCONH—, —NHCOO—, —COO—, —$SO_2$—, —CO— or —O—, J represents —CONH— or —COO—, K represents an unsubstituted or substituted alkylene group having 1 to 10 carbon atoms, an unsubstituted or substituted aralkylene group having 7 to 12 carbon atoms, or an unsubstituted or substituted arylene group having up to 10 carbon atoms, wherein the alkylene group may be straight or branched, Q represents a cyan forming coupler group, a magenta forming coupler group or a yellow forming coupler group capable of forming a dye by coupling with an oxidation product of an aromatic primary amine developing agent, and m and n each represents 0 or 1.

23. A silver halide color photographic light-sensitive material as claimed in claim 22, wherein the alkylene group is a methylene group, a methylmethylene group, a dimethylmethylene group, a dimethylene group, a trimethylene group, a tetramethylene group, a pentamethylene group, a hexamethylene group or a decylmethylene group, the aralkylene group is a benzylidene group, and the arylene group is a phenylene group or a naphthylene group.

24. A silver halide color photographic light-sensitive material as claimed in claim 23, wherein the substituents of the alkylene group or arylene group are an aryl group, a nitro group, a hydroxyl group, a cyano group, a sulfo group, an alkoxy group, an acyloxy group, an acylamino group, a sulfoamido group, a halogen atom, a carboxyl group, a carbamoyl group, an alkoxycarbonyl group or a sulfonyl group.

25. A silver halide photographic light-sensitive material as claimed in claim 22, wherein the cyan forming coupler group in the color coupler groups represented by Q is a phenol group represented by general formula (CIII) or a naphthol group represented by general formula (CIV),

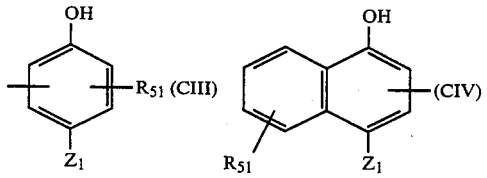

wherein $R_{51}$ represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsufonamido group, an alkylureido group, an arylcarbamoyl group, an arylamido group, an arylsulfamoyl group, an arylsulfonamido group or an arylureido group, provided that when two or more substituents are present, they may be identical or different, and $Z_1$ represents a hydrogen atom, a halogen atom, a sulfo group, an acyloxy group, an alkoxy group, an aryloxy group, a heterocyclic oxy group, an alkylthio group, an arylthio group or a heterocyclic thio group.

26. A silver halide color photographic light-sensitive material as claimed in claim 25, wherein $Z_1$ is substituted with an aryl group, a nitro group, a hydroxyl group, a cyano group, a sulfo group, an alkoxy group, an aryloxy group, an acyloxy group, an acylamino group, a sulfonamido group, a sulfamoyl group, a halogen atom, a carboxyl group, a carbamoyl group, an alkoxycarbonyl group or a sulfonyl group.

27. A silver halide color photographic light-sensitive material claimed in claim 22, wherein the magenta forming coupler group in the color coupler group represented by Q is a pyrazolone group (CV):

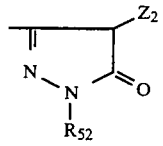

(CV)

wherein $R_{52}$ represents an alkyl group, a substituted alkyl group, an aryl group or a substituted aryl group, and $Z_2$ represents a hydrogen atom or a releasing group bonding to the coupling position through an oxygen atom, a nitrogen atom or a sulfur atom.

28. A silver halide color photographic light-sensitive material as claimed in claim 27, wherein the substituent for said alkyl group is a halogen atom, a cyano group or a benzyl group, and the substituent for said aryl group is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkyl sulfamoyl group, an alkylthio group, an arylthio group, a cyano group, a nitro group or a halogen atom.

29. A silver halide color photographic light-sensitive material as claimed in claim 27, wherein the oxygen atom, nitrogen atom or sulfur atom contained in $Z_2$ is bonded to a group selected from an alkyl group, an aryl group, an alkylsulfonyl group, an arylsulfonyl group, an alkylcarbonyl group, an arylcarbonyl group and a heterocyclic group which contains an oxygen atom, a nitrogen atom or sulfur atom, provided that when $Z_2$ is bonded to the coupling position through a nitrogen atom, $Z_2$ may represent a group capable of becoming a releasing group by forming a 5-membered or 6-membered ring containing the nitrogen atom.

30. A silver halide color photographic light-sensitive material as claimed in claim 22, wherein the yellow forming coupler group in the color coupler group represented by Q is an acylacetanilide group.

31. A silver halide color photographic light-sensitive material as claimed in claim 22, wherein the yellow forming coupler group in the color coupler group represented by Q is a pivaloylacetanilide group represented by general formula (CVI) or a benzoylacetanilide group represented by general formula (CVII) or (CVIII):

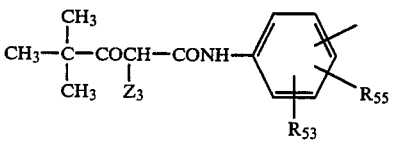

(CVI)

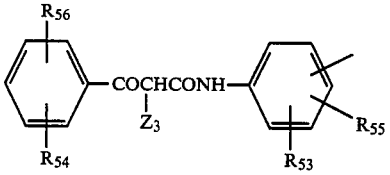

(CVII)

-continued (CVIII)

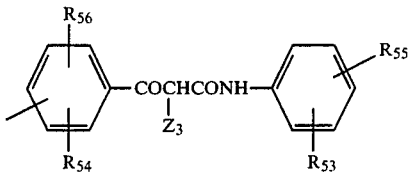

wherein $R_{53}$, $R_{54}$, $R_{55}$ and $R_{56}$ each represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkyksulfonamido group, an alkylureido group, an alkyl substituted succinimido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group or a thiocyano group, which may be identical or different, and $Z_3$ represents a hydrogen atom or a group represented by the following general formula (CIX), (CX), (CXI) or (CXII):

(CIX)

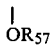

wherein $R_{57}$ represents an aryl group or a heterocyclic group, which may be substituted,

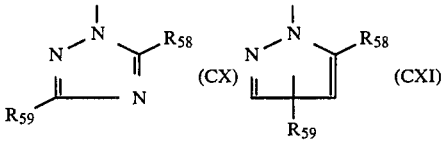

wherein $R_{58}$ and $R_{59}$ each represents a hydrogen atom, a halogen atom, a carboxylic acid ester group, an amino group, an alkyl group, an alkylthio group, an alkoxy group, an alkylsulfonyl group, an alkylsufinyl group, a carboxylic acid group, a sulfonic acid group, an unsubstituted or substituted phenyl group or a heterocyclic group, which may be identical or different, and (CXII)

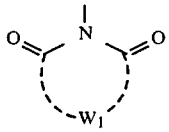

wherein $W_1$ represents non-metal atoms necessary to form a 4-membered ring, a 5-membered ring or a 6-membered ring together with

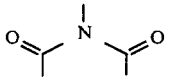

in the formula.

32. A silver halide color photographic light-sensitive material as claimed in claim 31, wherein the group represented by the general formula (CXII) is represented by formula (CXIII), (CXIV) or (CXV):

(CXIII)

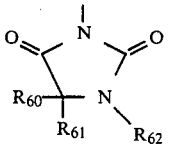

(CXIV)

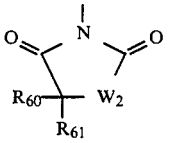

(CXV)

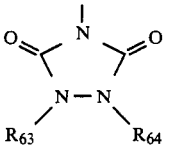

wherein $R_{60}$ and $R_{61}$ represent each a hydrogen atom, an alkyl group, an aryl group, an alkoxy group, an aryloxy group or a hydroxyl group, $R_{62}$, $R_{63}$ and $R_{64}$ represent each a hydrogen atom, an alkyl group, an aryl group, an aralkyl group or an acyl group, and $W_2$ represents an oxygen atom or a sulfur atom.

33. A silver halide color photographic light-sensitive material as claimed in claim 22, wherein the noncoloring monomer is selected from acrylic acid, α-chloroacrylic acid, α-alacrylic acid, and esters and amides of acrylic acid, α-chloroacrylic acid and α-alacrylic acid.

* * * * *